US006463776B1

(12) United States Patent
Enoki et al.

(10) Patent No.: US 6,463,776 B1
(45) Date of Patent: Oct. 15, 2002

(54) METHOD OF MANUFACTURING BOTTLE TYPE CAN

(75) Inventors: Yasushi Enoki; Yukio Ogawa; Hirotomo Tamiya; Yoshinao Shima, all of Sagamihara (JP)

(73) Assignee: Daiwa Can Company, Tokyo (JP)

( * ) Notice: Subject to any disclaimer, the term of this patent is extended or adjusted under 35 U.S.C. 154(b) by 0 days.

(21) Appl. No.: 09/856,146

(22) PCT Filed: Sep. 27, 2000

(86) PCT No.: PCT/JP00/06651

§ 371 (c)(1),
(2), (4) Date: May 30, 2001

(87) PCT Pub. No.: WO01/23117

PCT Pub. Date: Apr. 5, 2001

(30) Foreign Application Priority Data

Sep. 30, 1999 (JP) ..... 11-277784
Oct. 13, 1999 (JP) ..... 11-290406

(51) Int. Cl.[7] ..... B21D 51/40
(52) U.S. Cl. ..... 72/46; 72/379.4
(58) Field of Search ..... 72/46, 348, 356, 72/379.4

(56) References Cited

U.S. PATENT DOCUMENTS 2,359,775 A * 10/1944 McManus et al.
3,832,962 A * 9/1974 Rolles ..... 72/46
5,822,843 A * 10/1998 Diekhoff et al. ..... 72/348

FOREIGN PATENT DOCUMENTS

JP 59-115239 * 7/1984
JP 64-62231 * 3/1989

* cited by examiner

*Primary Examiner*—Lowell A. Larson
(74) *Attorney, Agent, or Firm*—Oblon, Spivak, McClelland, Maier & Neustadt, P.C.

(57) ABSTRACT

The invention is a bottle-shaped can manufacturing method of shaping a neck portion, a shoulder portion and a body portion integrally. The method comprises: a step of shaping a covered metallic sheet, as prepared by forming thermoplastic resin covering films on the two surfaces of a metallic sheet and by applying a lubricant to the thermoplastic resin covering films, into a cup shape by punching out the metallic sheet; a step of shaping the shaped cup into a bottomed cylindrical can reduced in diameter and thinned at its body portion; a step of shaping the bottom side of the bottomed cylindrical can into a shoulder portion and an unopened neck portion; a step of removing the lubricant at least from the outer surface of the can which is not opened at its neck portion but opened at the lower end of its body portion; a step of applying a printed design to the outer surface of the body portion cleared of the lubricant; and a step of shaping a cut end portion, as opened by cutting the leading end portion of the unopened neck portion, into a curled portion and shaping a threaded portion below the curled portion. Therefore, a protective covering film can be formed in a homogeneous state on the metallic surface of the can. On the other hand, a decorative print can be satisfactorily applied to the outer surface of the body portion of the can. For handling the can at the printing step, moreover, there can be converted a transfer apparatus by the vacuum or compressed air injection mechanism which has been employed in the prior art.

19 Claims, 10 Drawing Sheets

METHOD OF MANUFACTURING BOTTLE TYPE CAN

TECHNICAL FIELD

The present invention relates to a manufacturing method for a bottle-shaped can, of which a can body, a shoulder portion and a neck portion are integrally shaped from a metallic sheet (or a metal sheet), and, more particularly, to a method of manufacturing a bottle can with the outer surface of its body portion or the outer surface of the portion from its body portion to its shoulder portion being decorated with a print or the like.

BACKGROUND ART

As beverage cans for various soft drinks, juice or beer, there are generally employed the two-piece cans, of which the can body (or side wall portion) and the can bottom (or end wall portion) are integrally shaped. The two-piece can of this kind is manufactured by a suitable method such as by drawing and ironing, by drawing/redrawing, or by drawing/redrawing and stretching a metallic sheet such as an aluminum alloy sheet or a surface-treated steel sheet.

In such a two-piece can, there are integrally shaped the can bottom having a domed shape for improving the pressure resistance and the thinned body portion, and the open upper end portion of the body portion side wall is necked in to reduce the diameter and is flanged.

Moreover, the two-piece can is filled with a body such as a juice, soft drinks or beer, and the flanged portion of the open body portion is then seamed and sealed with an easy open can end having a smaller diameter than the external diameter of the body portion so that the can is shipped as a beverage can.

This beverage can is opened by a consumer having purchased it when the consumer pulls a tab fixed on the easy open can end.

As disclosed in WO 81/01259, on the other hand, there is also manufactured a bottomed cylindrical can which is shaped to have a thinner body wall than a bottom wall by drawing and redrawing (or by bending and extending at the redrawing time or by stretching) the surface-treated steel sheet having two sides laminated with a thermoplastic resin film. The can thus manufactured is necked in and flanged like the aforementioned can so that it may be used as the beverage can.

As the containers for soft drinks, juices, teas or coffees, on the other hand, there have been employed in recent years the bi-oriented molded containers (i.e., the PET bottle) made of a polyethylene terephthalate resin. Accordingly, the various soft drinks and others contained in the re-sealable PET bottles are mass-produced and sold by filling the bottles with them and by sealing the bottles with the threaded caps.

These beverage PET bottles have an advantage over the can containers for the beverages in that they can be repeatedly sealed with the caps. However, the PET bottles are in considerably lower states than those of the can containers in the recycling ratio for recovering and recycling the bottles. Therefore, it has been investigated to enhance the conveniences of the can containers by adding to the re-sealing function to the can containers having a high recycling ratio.

As the metallic cans which can be re-sealed with the threaded caps, there are disclosed in Japanese Patent Laid-Open No. 10-509095 (WO96/15865) several types of bottle-shaped drawn/ironed cans (i.e., DI cans) having shapes similar to those of the PET bottles, i.e., the DI cans which have threaded neck portions to be screwed with threaded caps.

These DI cans are classified into: the type in which an end sheet to be seamed on the open upper end of a can body is formed to form a threaded neck portion integrally; the type in which the threaded neck portion is integrally formed by reducing the diameter of the open upper end side of the can body stepwise by the neck-in working (i.e., by making the diameter smaller toward the open end); and the type in which the small diametrical neck portion and the shoulder portion having a slope are formed by drawing the drawn bottom E portion side (or the end wall portion) of a cup at multiple steps, in which the neck portion is then opened and is curled and threaded, in which the body portion of the cup is then drawn and ironed into a thin body portion, and in which a separate bottom end is seamed and fixed on the open end of the body portion on the side opposed to the neck portion.

In the above-specified Laid-Open, moreover, there are disclosed not only the structures of the bottle-shaped cans of the individual types but also their shaping (or forming) methods.

According to the disclosure of Japanese Patent Laid-Open No. 58-47520, on the other hand, at the time of drawing the can body, the bottom portion is drawn into a convex stepped shape, and this convex stepped shape is redrawn at an ironing time, to form a stepped convex portion having a small diametrical cylindrical neck portion and a raised shoulder portion. This neck portion is threaded and is sealed with the threaded cap. After this DI can was filled with a beverage from the end opening of the body portion, this end opening is sealed by seaming and fixing the can end.

In Japanese Patent Laid-Open No. 64-47520, moreover, the following concept is disclosed. By pressing (or drawing) the bottom side of the DI can shaped by the drawing/ironing treatment, there are shaped a small diametrical cylindrical neck portion and a frustoconical shoulder portion. The leading end portion of the neck portion is trimmed, and the lubricant having stuck the inner and outer surfaces of the can is degreased/rinsed. The inner and outer surfaces of the can are conversion coated and dried. After this, a coating for the inner surface is sprayed on the inner surface of the can. After the coating is dried, a print is applied to the outer surface of the body portion of the can. After this printing ink is dried, a can end is seamed and fixed on the open end of the body portion. After this, a threaded cylindrical member of a resin is fitted on the neck portion, or this neck portion is screw-cut.

Of the aforementioned bottle-shaped cans which can be sealed again with the threaded cap, the can of the type in which the threaded neck portion is formed integrally with the end sheet is formed at its body into the DI can or a bottomed can such as the DTRD can (Drawn Thin Redrawn) having been drawn and bent/extended (or stretched) or the can having been drawn and bent/extended (or stretched) and ironed. The can body is filled with a content such as a beverage, and the open end portion of the can body is seamed/fixed and sealed with the end sheet having the threaded neck portion formed integrally therewith.

According to the bottle-shaped can of this type, therefore, the can body has a shape substantially identical to that of the existing general can, and enjoys an advantage that few changes are required in the filling facilities to suppress the cost for the facilities.

In the bottle-shaped can of this type, however, the end sheet seaming portion is located in the upper portion of the can to raise problems that dust is liable to accumulate in the concave portion inside of the seamed portion, and that the seamed portion itself protrudes to deteriorate the appearance.

In the bottle-shaped can of the type in which the neck portion is formed not at the end sheet but integrally at the upper end portion of the can body, on the other hand, the upper end portion is stretched thin and worked hard by a similar working as the can body is drawn and ironed or bent and extended. Considering the later step of working the neck portion, therefore, the upper end portion of the can body is worked so relatively thick as to make the extension of the material less than the lower portion (or as to reduce the work hardening extent).

Since the neck portion has a considerably smaller diameter than that of the can body (or the body portion of the can), however, a diameter reduction ratio for forming the neck portion is so large as to make it necessary to make a diameter reduction work many times.

When the number of the diameter reduction work is reduced by enlarging one drawing rate, on the other hand, the can body is wrinkled or cracked at its upper end portion.

In order that a small cap may be used to lower the cost for the material and that the consumer may drink the beverage in the can directly from the neck portion without spilling the content, it is desired to reduce the diameter of the neck portion more than the external diameter of the can body.

In order to satisfy these desires, it is necessary to make the reduction ratio higher for forming the neck portion by drawing the open upper end of the can body, and this necessity requires several tens of neck-in steps.

For example, the can to be relatively frequently used as the body can for beer has a body diameter of about 66 mm (the so-called "211 diameter"), and twenty to thirty necking steps are required if the neck portion of such can is to be necked in to a diameter of about 28 mm.

Thus, in the bottle-shaped can having the neck portion formed by reducing the diameter of open upper end of the can body, a number of necking machines are required to raise the cost for the facilities, and the increase in the number of working steps makes it frequent to damage or deform the can thereby to lower the quality of the can.

In the bottle-shaped can of the type in which the shoulder portion and the neck portion are formed by working the can bottom, on the contrary, the can bottom portion or the portion to be formed in a portion of the shoulder portion and the neck portion is hardly affected by the working to form the can so that the working is applied to the portion having no work hardening and having a thickness substantially equal to that of the original metallic sheet. When the can bottom is to be drawn, moreover, the diameter of the neck portion can be reduced while being unwrinkled.

As compared with the case in which the neck portion is formed by necking in the upper portion of the aforementioned can body, therefore, one drawing rate can be increased to reduce the diameter more by one step thereby to drastically reduce the number of steps for forming the neck portion.

On the other hand, the bottle-shaped can of the type in which the bottom side is worked to shape the shoulder portion and the neck portion has neither a seamed portion at its upper portion nor a recess liable to trap dust while the can is displayed at a store front, so that it has an excellent appearance.

Here in the aforementioned bottle-shaped can which has its neck portion, shoulder portion and body portion shaped integrally so that it can be re-sealed with the threaded cap, a protecting coating film is applied to the metallic surface of the can so as to protect the content and retain the corrosion resistance. If the metallic sheet is then pre-coated with the protecting coating film, this film is damaged when the can is ironed. It is, therefore, disclosed in Japanese Patent Laid-Open No. 10-509095 that the protecting coating film is formed after the ironing treatment.

In Japanese Patent Laid-Open No. 58-47520, on the other hand, it is not disclosed in the least when the protecting coating film is applied, when the small diametrical cylindrical portion is cut and opened or when the same is threaded.

According to the disclosure of Japanese Patent Laid-Open No. 64-47520, on the other hand, a bottomed cylindrical can body having a thin body portion is shaped by the drawing treatment and the ironing treatment. After this, the can body is drawn at its bottom portion to shape a small diametrical cylindrical portion and a frustoconical shoulder portion. After the upper end portion of the small diametrical cylindrical portion is cut and removed, a degreasing treatment is performed to rinse the inner and outer surfaces of the can body, and this body is dried. A protective coating is then applied to the inner surface of the can body and is dried. After this, a print is applied to the outer surface of the can body.

According to our experiences, however, it is seriously difficult to apply a protective coating of a uniform thickness to the metal surface of a can (before the bottom end is fixed) having the curled portion or the threaded portion formed at the small diametrical neck portion and to dry and set the coating to a proper state.

According to the shaping method utilizing the ordinary DI can manufacturing method, on the other hand, a cup of a metallic sheet having a surface laminated with no thermoplastic resin is redrawn and ironed while spraying much water lubricant to the cup. Therefore, much degreasing liquid, conversion coating liquid and rinsing water is required for the rinsing treatment. This makes it necessary to employ large-sized rinsing facilities and the much lubricant, degreasing liquid, conversion coating liquid and rinse water. This necessity is a factor to raise the can manufacturing cost drastically.

In order to simplify the degreasing treatment after the can body is shaped, therefore, we have adopted the following method. A thermoplastic resin film layer performing a function as the lubricant is formed in advance as the protective film on the metallic sheet for the material of the can, and a small amount of lubricant is applied to the protective film. The coated metallic sheet thus having the protective film is shaped into an integral structure of a thin body portion, a shoulder portion and a neck portion. After this, the neck portion is shaped to have a curled portion and a threaded portion.

The bottle-shaped can thus manufactured from the coated metallic sheet need not be coated later for protecting it. If a high-temperature volatile (or sublimable) lubricant is employed, the degreasing treatment can be simply effected by a heating treatment. Even in the case of a non-high-temperature volatile lubricant, on the other hand, the degreasing treatment can be effected with a small amount of rinse water.

Where a print of letters or decorative patterns is to be applied to the body portion of a container, the PET bottle can not be printed directly on the entire circumference of the bottle body, or a printed resin film cannot be fusion-bonded as a matter of fact, because its body portion is not circular, corrugated or extremely thin. Therefore, the print is applied by shrink-packaging the bottle body with a printed heat-shrinkable film.

In the metallic bottle-shaped can of the type in which the threaded neck portion, the shoulder portion and the body portion are integrally shaped and in which the bottom end is seamed and fixed on the lower end portion of the body portion, an opening of the same external diameter as that of the body portion is kept till the neck-in step before the bottom end is fixed. It is, therefore, possible to print the can body directly as in the two-piece can of the prior art and to thermally adhere (or fusion-bond) the printed resin film. Thus, an appearance different from that of the PET bottle can be obtained to differentiate the products.

Even where the body portion, the shoulder portion and the neck portion of the metallic bottle-shaped can are to be integrally shaped from the coated metallic sheet having the protective film, however, this protective film may be damaged by the friction at the shaping time by the drawing or ironing treatment, unless the lubricant is applied in advance to the surface of the coated metallic sheet. Where the decorative print is to be applied to the body of the bottle-shaped can, on the other hand, it is made impossible from the view points of the repellency of the ink or adhesiveness to directly print the outer surface of the can in the state having the lubricant or to fusion-bonding the printed resin film to the same. Therefore, it is a problem what stage (time) of the manufacture process is most suitable to the printing (or the fusion-bonding of the printed resin film).

In the aforementioned Japanese Patent Laid-Open No. 58-47520, there is no disclosure at what point of time the decorative print should be applied.

In the aforementioned Japanese Patent Laid-Open No. 64-62233, on the other hand, the following is disclosed. After the bottomed cylindrical can body is drawn at its bottom side to shape the small diametrical cylindrical portion and the frustoconical shoulder portion, the upper end portion of the small diametrical cylindrical portion is cut and removed. After this, the can body is rinsed at its inner and outer surfaces and is dried. After this, the coating is sprayed on the inner surface of the can body. After the coating is dried, the coating and the print are applied to the outer surface of the can body.

According to the manufacturing method for the bottle-shaped can body, as disclosed in that Laid-Open, the coating is sprayed on the inner surface of the cylindrical can body after this can body is drawn at its bottom portion to form the small diametrical cylindrical portion and the frustoconical shoulder portion.

It is, however, not easy to apply the protective coating of a uniform thickness to a body having portions of different diameters combined, such as the inner surface of the bottle-shaped can body after the cylindrical body portion, the frustoconical shoulder portion and the small diametrical cylindrical portion are formed.

For coating the inner surface of an article having such complicated shape, more specifically, the spray coating is commonly used, as disclosed in that Laid-Open. However, the coating film is liable for the spray coating to become thick at a small diametrical portion but thin at a large diametrical portion. Therefore, a coating consumption is excessively high if a sufficient application is to be retained for the thin portion, and a coating film thickness for retaining a sufficient corrosion resistance cannot be obtained if the coating consumption is limited.

Where the coating film thickness on the inner surface of the bottle-shaped can is seriously different at portions, on the other hand, the drying degree disperses when the coated film is dried/baked. Therefore, sufficient corrosion resistance and adhesion may not be able to be obtained to make the drying/baking works difficult.

In the bottle-shaped can body manufacturing method disclosed in the Laid-Open, moreover, the can body is printed on its outer surface after the small diametrical cylindrical portion for the threaded neck portion is cut/removed at its upper end portion (or its leading end portion). If, in this case, there is diverted the dry offset printer which is employed for printing the ordinary two-piece can (e.g., the DI can or the deeply drawn can), this diversion is impossible unless a drastic modification is made. This raises a problem that the cost for the facilities is raised.

In Japanese Patent Laid-Open No. 10-509095, there is disclosed the bottle-shaped can in which the body portion, the shoulder portion and the small diametrical cylindrical portion are integrally shaped. The cup, as adapted by the drawing treatment, is shaped to form the small diametrical cylindrical portion and the shoulder portion. After this, the small diametrical cylindrical portion is cut and opened at its leading end portion. After this, the small diametrical cylindrical portion is curled and threaded at its leading end portion. Moreover, the cup is redrawn and ironed to elongate the can body wall and is coated for the protection. Therefore, the problem of the bottle-shaped can disclosed in Japanese Patent Laid-Open No. 64-62233 is just as the same as that of the bottle-shaped can of the aforementioned type, as disclosed in Japanese Patent Laid-Open No. 10-509095.

In the prior art in which the two-piece can is directly printed at its cylindrical body portion or in which the printed resin film is fusion-bonded to the body portion of the two-piece can, as disclosed in Japanese Patent Laid-Open No. 9-295639 (corresponding to EP-A2-0,808,706), the transfer means employed for feeding/discharging the cans to the mandrels or the like of a printing apparatus or a printed resin film applying apparatus is exemplified by the transfer means utilizing the vacuum and compressed air injection Glmechanism (as disclosed in Japanese Patent Laid-Open No. 48-58905 (corresponding to U.S. Pat. No. 3,766,851), Japanese Patent Laid-Open No. 52-41083 (corresponding to U.S. Pat. No. 4,048,917), U.S. Pat. No. 4,092,949, Japanese Patent Laid-Open No. 54-92810, Japanese Patent Laid-Open No. 57-170758 or Japanese Patent Laid-Open No. 57-178754).

For the printing of the bottle-shaped can body disclosed in Japanese Patent Laid-Open No. 64-62233 or Japanese Patent Laid-Open No. 10-509095, the transfer means utilizing the vacuum and compressed air injection mechanism cannot be used at the printing time when the bottle-shaped can body is to be fed to and discharged from the mandrels of the printing apparatus, because an opening is present at the leading end portion of the small diametrical cylindrical portion in addition to the opening at the leading end of the body portion.

It is, therefore, necessary to add a mechanism for grasping and pushing the bottle-shaped can body reliably on the mandrels of the printing apparatus and a mechanism for grasping and removing the bottle-shaped can body reliably from the mandrels. As a result, those modifications to the printing apparatus raise a problem that high expenses are required for the facilities to raise the cost considerably for manufacturing the can.

Since the bottle-shaped can body is grasped for its transfer, on the other hand, there arises another problem that the transfer rate is reduced to have a low printing speed.

A main object of the invention is to provide a method for manufacturing such a re-sealably threaded bottle-shaped can at a low cost that a small diametrical neck portion, a shoulder portion and a large diametrical body portion are integrally molded from a metallic sheet (or a metal sheet), that a homogeneous protective film is applied to the inner surface of this portion, and that a decoration print is applied at least to the body portion.

A more specific object of the invention is to provide a manufacturing method for a re-sealably threaded bottle-shaped can, in which no protective coating is needed on the inner surface of the can after manufactured and in which the decoration print can be applied to the body portion without any drastic modification on the decorating apparatus of the prior art for the outer surface of the body portion of the two-piece can.

DISCLOSURE OF THE INVENTION

In order to achieve the above-specified objects, according to the invention, there is provided a manufacturing method for a bottle-shaped can in which a small diametrical neck portion, a shoulder portion having a sloped face and a large diametrical body portion are integrally shaped, in which a decoration print is applied at least to the outer surface of the body portion and in which a bottom end is fixed on the lower end portion of the body portion, comprising: a cup shaping step of preparing a covered metallic sheet, by forming thermoplastic resin coating films on the two surfaces of a metallic sheet and by applying a lubricant to the thermoplastic resin coating films, and punching out the covered metallic sheet to form a cup shape; a can shaping step of shaping the shaped cup further into a bottomed cylindrical can which is reduced at diameter of the body and thinned at its body portion; a diametrical small cylindrical portion shaping step of shaping the bottom portion of the bottomed cylindrical can and the body portion in the vicinity of the bottom portion into the shoulder portion and an unopened small diametrical cylindrical portion; an opening step of cutting and opening the leading end portion of the small diametrical cylindrical portion; a neck portion shaping step of shaping the neck portion by threading the outer circumference of the opened small diametrical cylindrical portion; a lubricant removing step of removing the lubricant from the outer surface of the bottomed cylindrical can, between the step of shaping the bottomed cylindrical can having the thinned body portion and the step of cutting and opening the leading end portion of the small diametrical cylindrical portion; and a decorating step of decoratively printing the outer surface of the body portion of the bottomed cylindrical can cleared of the lubricant, between the step of shaping the bottomed cylindrical can having the thinned body portion and the step of cutting and opening the leading end portion of the small diametrical cylindrical portion.

According to the bottle-shaped can manufacturing method of the invention, therefore, the metallic sheet still in the flat state before shaped is laminated in advance on its two surfaces with the thermoplastic resin so that the thermoplastic resin as the protective film can be applied in the uniform thickness to the metallic sheet surfaces. Since the small diametrical cylindrical portion (or the neck portion), the shoulder portion and the body portion are integrally shaped from the coated metallic sheet (i.e., the metallic sheet with the protective film) prepared by applying the lubricant to the thermoplastic resin layer, on the other hand, the protective film for protecting the metallic sheet of the can is not damaged at the step of shaping the small diametrical cylindrical portion, the shoulder portion and the body portion integrally. Since the protective film is formed of the thermoplastic resin layer, moreover, this thermoplastic resin layer not only functions a lubricant fi when the small diametrical cylindrical portion (or the neck portion) is bent or threaded after the lubricant is removed but also is extended or bent following the extension or bend of the metallic surface, so that protective film does not peel off.

In short, no protective covering need be applied to the inner surface and the outer surface of the shaped can. As a result, there is raised neither such problems in the coating workability or in the irregularity of the thickness of the protective film as might otherwise occur where the coating is sprayed to the inner surface of the can after made.

According to the bottle-shaped can manufacturing method of the invention, on the other hand, the step of removing the lubricant from the body portion of the can and the step of printing the decoration are performed after the bottomed cylindrical can having the thinned body portion is shaped and before the small diametrical cylindrical portion is cut and opened at its leading end portion. By employing the transfer means according to the vacuum or compressed air injection mechanism which the printing apparatus or the printed film resin film adhering apparatus of the prior art is equipped with, therefore, the bottle-shaped can can be fed to and discharged from the mandrels of the printing apparatus or the printed resin film adhering apparatus. Therefore, the decoration step can be effected at a high speed.

In the bottle-shaped can manufacturing method of the invention, on the other hand, the step of printing the body portion of the can or adhering the printed resin film is performed after the lubricant removing step so that the printing operation or the printed resin film adhering operation can be performed in a satisfactory state.

In the method of the invention, on the other hand, the lubricant removing step and the decoration step may be executed between the small diametrical cylindrical portion shaping step and the opening step.

In the bottle-shaped can manufacturing method of the invention, therefore, the shoulder portion and the small diametrical cylindrical portion are shaped before the lubricant is removed, so that these shaping steps are performed with the lubricant being left on the thermoplastic resin layer. It is, therefore, possible to perform the numerous steps of shaping the small diametrical cylindrical portion and the shoulder portion while preventing the thermoplastic resin film from being damaged.

In the bottle-shaped can manufacturing method of the invention, on the other hand, the bottle-shaped can at the instant when it is fitted (or crowned) on the mandrels of the printing apparatus or the printed resin film adhering apparatus has a small diametrical cylindrical portion formed on its bottom portion. By the modifications that the mandrel is partially matched to the shape of the shoulder portion of the can and that the inner surface of the vacuum pad for sucking the can is partially matched to the shape of the shoulder portion shape of the can, however, the vacuum and compressed air injection mechanism can be employed when the can is to be fed to and discharged from the mandrel. Therefore, it is possible to suppress the cost for the modifications.

In the method of the invention, still moreover, the lubricant removing step and the decoration step may be executed between the can shaping step and the small diametrical cylindrical portion shaping step, and a lubricant applying step of applying a lubricant at least to the outer surface of the bottomed cylindrical can may be executed immediately after the decoration step.

In the bottle-shaped can manufacturing method of the invention, therefore, at the stage where the bottomed cylindrical can is shaped, the lubricant is removed, and the decoration print is applied to the outer surface of the cylindrical body portion. Therefore, the printing apparatus or the printed resin film adhering apparatus, as has been employed for printing the body portion of the two-piece can, can be employed without any modification.

In the bottle-shaped can manufacturing method of the invention, on the other hand, after the body portion is printed, the lubricant is applied to the bottle-shaped can, and the can bottom portion including the vicinity of the bottom portion of the printed body portion is shaped into the shoulder portion and the small diametrical cylindrical portion. It is, therefore, possible to manufacture the can in which the decoration print is applied at least to such a portion of the shoulder portion of the bottle-shaped can as can not be decoratively printed by the ordinary printing means.

Still moreover, the small diametrical cylindrical portion shaping step of the method of the invention may be executed: such that the bottomed cylindrical can is preliminary molded at its bottom corner portion into a curved shoulder face having an arcuate longitudinal section and is then drawn at its bottom portion into a bottomed cylindrical portion of a smaller diameter than that of the body portion while the curved shoulder face of the bottom corner portion being unwrinkled by a pair of unwrinkling pusher and drawing dies having curved faces to contact closely with the curved shoulder face; such that after this, an unwrinkling pusher, which is provided at its leading end portion with a tapered face having a substantially straight longitudinal section approximating a tangential line drawn to an arcuate longitudinal section of a virtual curved face leading to a preformed curved shoulder face, a redrawing dies, which is positioned at a portion to face at least the unwrinkling pusher and which is provided at its leading end portion with a tapered face having a substantially straight longitudinal section approximating a tangential line drawn to an arcuate longitudinal section of a preformed curved shoulder curved face, and a redrawing punch are used to perform one or more redrawing treatments for reducing the diameter of the bottomed cylindrical portion, while the bottom corner portion of the bottomed cylindrical portion of the small diameter formed by the drawing treatment being unwrinkled, thereby to shape the bottomed cylindrical portion of the small diameter into a small diametrical cylindrical portion of substantially the same diameter as that of the neck portion; and such that after this, one or two or more continuing tapered faces formed between the small diametrical cylindrical portion and the curved shoulder face are extended and re-shaped into a smooth curved face leading to the curved shoulder face by a pair of re-shaping tools having a surface shape of a virtual curved face extending from the curved shoulder face, to form the shoulder portion into a curved face of a domed longitudinal section.

According to the bottle-shaped can manufacturing method of the invention, therefore, it is possible to manufacture the bottle-shaped can which is provided between the small diametrical cylindrical neck portion and the cylindrical body portion with the shoulder portion having a domed curved face in the longitudinal section.

Alternatively, the small diametrical cylindrical portion manufacturing step of the method of the invention may be executed: such that at the small diametrical cylindrical portion shaping step, the bottomed cylindrical can is preliminary molded at its bottom corner portion into a He curved shoulder face of an arcuate longitudinal section and is then drawn at its bottom portion into a bottomed cylindrical portion of a smaller diameter than that of the body portion while the curved shoulder face of the bottom corner portion being unwrinkled by a pair of unwrinkling pusher and drawing dies having curved faces to contact closely with the curved shoulder face; such that after this, an unwrinkling pusher, which is provided at its leading end portion with a sloped face having a substantially straight longitudinal section approximating a tangential line drawn to an arcuate longitudinal section of a virtual curved face leading to a preformed curved shoulder face, a redrawing dies, which is positioned at a portion to face at least the pusher, which is provided at its leading end portion with a sloped face having a substantially straight longitudinal section approximating a tangential line drawn to an arcuate longitudinal section of a preformed curved shoulder face and which is provided at its portion on the leading end side from the sloped face with a bulging face having an arcuate longitudinal section, and a redrawing punch are used to perform one or more redrawing treatments for reducing the diameter of the bottomed cylindrical portion, while the bottom corner portion of the bottomed cylindrical portion of the small diameter formed by the drawing treatment being unwrinkled, thereby to shape the bottomed cylindrical portion of the small diameter into a radially small cylindrical portion of substantially the same diameter as that of the neck portion; and such that after this, one or two or more tapered faces formed between the small diametrical cylindrical portion and the curved shoulder face are extended and re-shaped into a smooth sloped face leading to the curved shoulder face by a pair of re-shaping tools having a surface shape of a straight longitudinal section approximating a tangential line drawn to a virtual curved face extending from the curved shoulder face, to form the shoulder portion shape into a smooth curved face of a straight longitudinal section leading to the curved shoulder face.

According to the bottle-shaped can manufacturing method of the invention, therefore, it is possible to manufacture the can which is decoratively printed at least on its body portion and which has the shoulder portion having the smooth curved face of the straight longitudinal section mainly.

On the other hand, the neck portion shaping step may be to curl the leading end portion of the small diametrical cylindrical portion opened, to form a curled portion and to thread the cylindrical portion below the leading end portion directly to form a thread.

According to the bottle-shaped can manufacturing method of the invention, therefore, the upper end of the neck portion is curled to provide a soft touch for the lips of a consumer when the consumer drinks the content directly from the neck portion of the bottle-shaped can. On the other hand, the neck portion is directly threaded to make the cost lower than the structure in which another threaded part is employed.

Alternatively, the neck portion shaping step may be to fit a cylindrical member of a resin threaded in advance, on the small diametrical cylindrical portion and to bend the leading end portion of the small m diametrical cylindrical portion opened, outward to bring the same into engagement with the cylindrical member of the resin.

According to the bottle-shaped can manufacturing method of the invention, therefore, the step of forming the threaded neck portion is simplified.

BEST MODE FOR CARRYING OUT THE INVENTION

A bottle-shaped can manufacturing method of the invention will be described in detail in connection with its specific embodiments.

Figure 1:
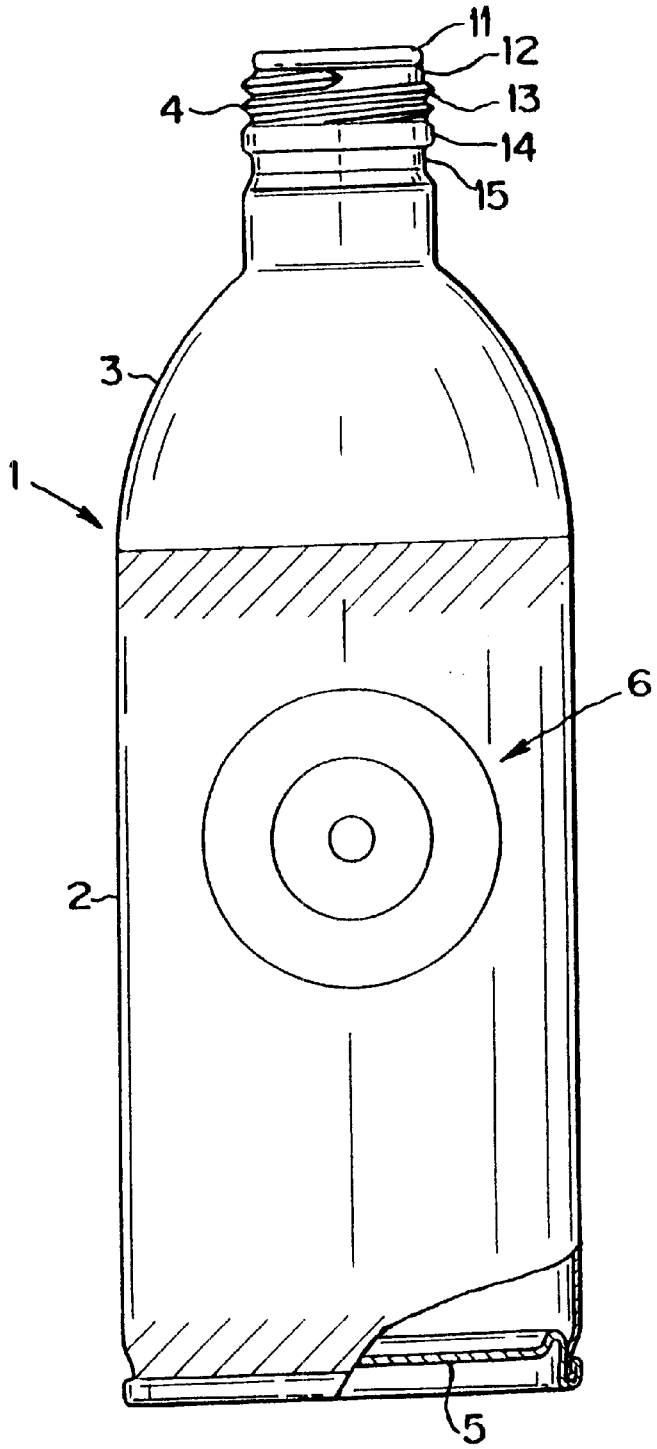
FIG. 1 is a partially sectional side elevation showing one example of a bottle-shaped can manufactured by a method of the invention.

FIG. 1 shows one example of the bottle-shaped can which is manufactured by the method of the invention. A bottle-shaped can 1, as shown, in which a smaller diametrical cylindrical neck portion 4 is formed integrally upward from a larger diametrical cylindrical can body 2 through a domed shoulder portion 3 having an arcuate longitudinal section, is sealed up at the lower end opening of the can body 2 by seaming and fixing a bottom end 5 thereon. On the outer surface of the can body 2, moreover, there is either directly printed a decoration 6 of desired letters or patterns or adhered a printed resin film so that the printed area (or the decoration area) may fall on a hatched cylindrical portion.

Figure 2:
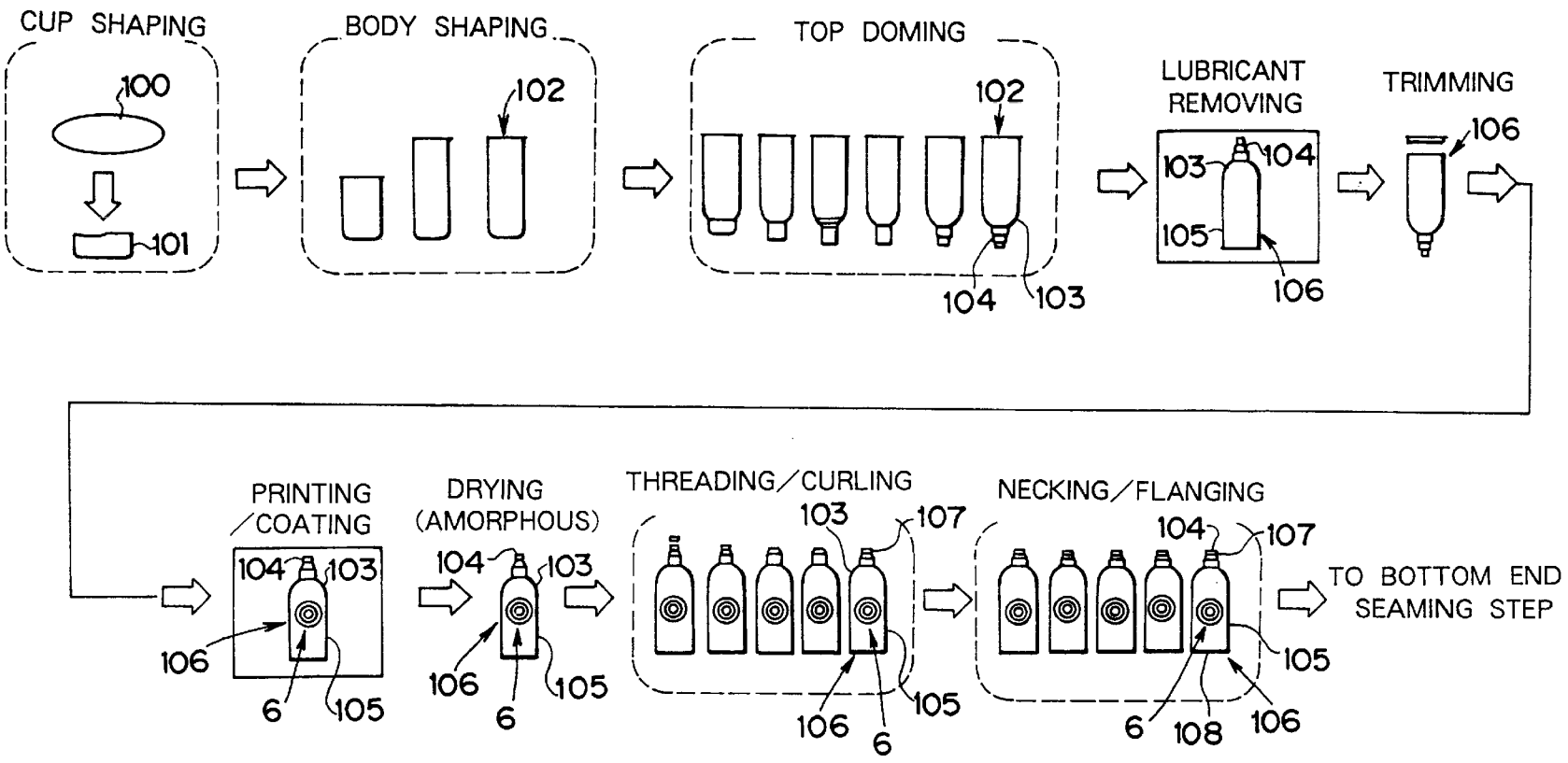
FIG. 2 is a process diagram for explaining a manufacture process for manufacturing the bottle-shaped can shown in FIG. 1.

FIG. 2 schematically shows a process for manufacturing the bottle-shaped can shown in FIG. 1. In the shown method, the used material is a covered metallic sheet which is prepared by forming a thermoplastic resin covering layer in an amorphous state on the two sides of a metallic sheet and by applying a high-temperature volatile lubricant to the two sides. At a first cup shaping step, a blank 100, as punched out in a disc shape from the covered metallic sheet, is drawn to shape a cup 101. At a next body shaping step, the cup 101 is redrawn at least one time to shape a bottomed cylindrical can 102 thinned to have a small diametrical body.

Next, at a top doming step, the bottomed cylindrical can 102 is drawn several times at its bottom portion to shape a shoulder portion 103 and an unopened neck portion 104. At a lubricant removing step, moreover, the can 102 is heated to a high temperature to remove the lubricant at least from the outer surface of a can 106 which has its neck portion unopened but a body portion 105 opened at its lower end. At a trimming step, moreover, the body portion 105 is trimmed at its opened end side opposed to the neck portion, to set the can 106 to a predetermined length, and the can 106 is transferred to a printing/coating step.

At this printing/coating step, the desired decoration 6 is printed on the body portion 105 of the can 106 having the body portion 105, the shoulder portion 103 and the unopened neck portion 104 shaped integrally and having the open lower end, and the thermosetting resin is applied as a clear top coating layer for protecting the printed ink layer, to the decoration 6. Here, this top coating layer may be an ultraviolet cured resin.

At a subsequent drying step, the printed ink layer of the decoration 6 and the top coating layer formed over the former are sufficiently dried, and the thermoplastic resin covering layer below the printed ink layer is made amorphous. After this, at a threading/curling step, the leading closed portion of the unopened neck portion 104 is trimmed to open the neck portion 104, and this opened end portion is curled while being widened outward, to form an annular curled portion. Moreover, the cylindrical circumferential wall forming the neck portion 104 is threaded at 107 for fastening the cap is beaded below the thread 107.

Then, at a necking/flanging step, an open lower end portion 108 on the other side of the neck portion 104 is sequentially necked-in and flanged. At a not-shown bottom end seaming step, moreover, a bottom end or a separate member made of a metallic sheet is integrally fixed on a flange formed on the open lower end portion of the body portion by a double seaming method using a seamer (or a can end seaming machine). Thus, there is completed the bottle-shaped can 1, as shown in FIG. 1.

Here will be described in more detail the method according to the invention for manufacturing the bottle-shaped can thus far described. The raw material or the metallic sheet is prepared to have a thickness of 0.1 to 0.4 mm by laminating a thermoplastic resin film of polyester resin or polypropylene resin on the two sides of an aluminum alloy sheet. More specifically, the metallic sheet employed is prepared by laminating a mixed resin film containing a polybutylene terephthalate resin (PBT) and a polyethylene terephthalate resin (PEI) (PBT: PET=60:40) with a thickness of 20 $\mu$m on the inner side and a thickness of 20 $\mu$m on the outer side of an aluminum alloy sheet 3004H191 defined in the Japanese Industrial Standards (JIS) and having a thickness of 0.315 mm.

Here, the method for laminating the thermoplastic resin film on the metallic sheet is exemplified not only by the method for thermally adhering the thermoplastic resin film filmed in advance, directly to the metal surface of the metallic sheet but also by extruding thermally adhering the melting thermoplastic resin film through a T-dies attached to an extruder, onto the metal surface of the metallic sheet preheated or a method for thermally adhering a thermoplastic resin film to the metal surface of the metallic sheet through an adhesive primer layer, a setting type adhesive layer or an excellently thermally adhesive thermoplastic resin layer. At this laminating step, in order to improve the workability and adhesiveness, it is preferable that the thermally adhered thermoplastic resin film is once melted and then quenched into an amorphous state by passing it through water, for example.

To the metallic sheet having the thermoplastic resin film layers formed on its two sides, there is applied as the lubricant one kind or two or more kinds of normal butyl stearate, fluid paraffin, petrolatum, polyethylene wax, food oil, hydrogen-added food oil, palm oil, synthetic paraffin or dioctyl sebacate. At the cup shaping step, the blank for each can is punched from the covered metallic sheet to which that lubricant has been applied. This blank is drawn into the cup shape. For example, the blank, as punched into a disc having a diameter of 170 mm, is drawn into a cup shape having a height of 48.3 mm and an external diameter of 100 mm.

At the subsequent body shaping step, the shaped cup is further redrawn two times. The shaped cup is bent/extended (or stretched) at the first redrawing step and is ironed at the second redrawing step by coupling a redrawing dies and an ironing dies. Thus, there is shaped a bottomed cylindrical can which has a smaller diameter but a larger height than the cup and which has a thinned body portion. Together with or after this shaping step, the bottomed cylindrical can is preformed at its bottom corner portion (i.e., the bottom portion and the body portion near the bottom portion) into a curved face (i.e., a curved face to form a portion of the shoulder) having an arcuate longitudinal section. The portion of this curved face corresponds to the shoulder portion 3 shown on the lefthand upper portion of FIG. 3. For example, a cup having a height of 48.3 mm and an external diameter of 100 mm is shaped into the bottomed cylindrical can having a height of 171.5 mm and an external diameter of 65.9 mm.

Figure 3:
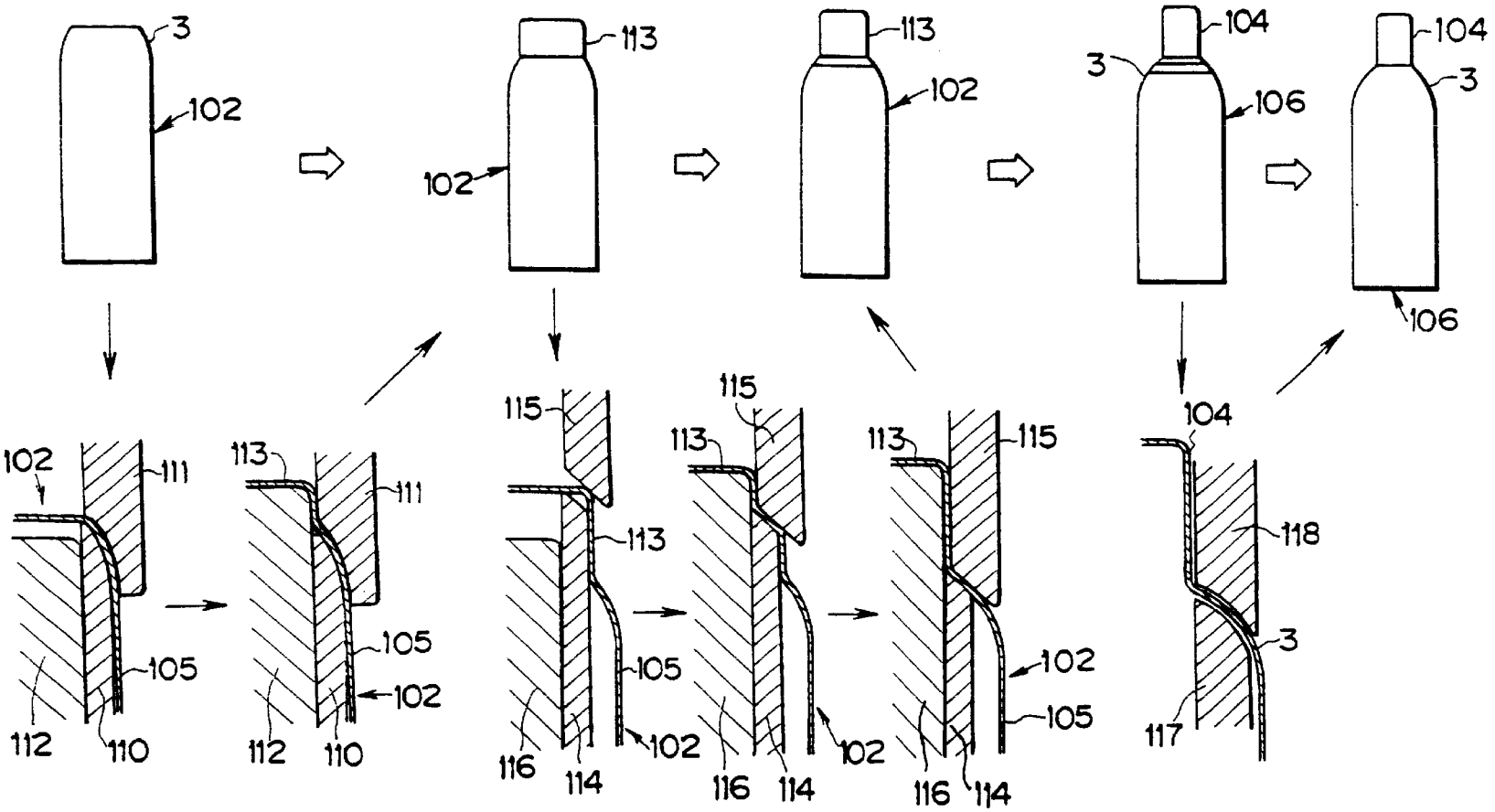
FIG. 3 is an explanatory diagram showing a shaped state of a neck portion and a shaped state of a shoulder portion at a top doming step of the process shown in FIG. 2.

In FIG. 3, there is shown the top doming step of forming a top dome of the can 102 which has been preformed at its bottom corner portion into the curved shoulder face. For conveniences of explanation, here is arranged the can 102 with its bottom side taking an upper position. First of all, the preformed can bottom corner portion is unwrinkled with an unwrinkling tool (including a drawing dies 111 and an unwrinkling pusher 110), which has a curved face to come into close contact with the curved face of the portion corresponding to the shoulder portion 3. In this state, the can bottom portion is drawn into a bottomed cylindrical shape having a smaller diameter than that of the body portion 105 by means of a drawing punch 112.

Moreover, an unwrinkling tool (including a redrawing dies 115 and an unwninkhing pusher 114) which is provided a tapered face having a straight longitudinal section approximating a tangential line drawn to an arcuate longitudinal section of a virtual curved face leading from that curved face preformed at its portion corresponding to the shoulder portion 3 is used to unwrinkle the bottom corner portion of a bottomed cylindrical portion of a smaller diameter formed at the can 102. The bottomed cylindrical portion 113 thus newly drawn is further drawn (or redrawn) in this state into a bottomed cylindrical shape of a smaller diameter by a redrawing punch 116. Here in the specific example being described, the bottom corner portion is preformed into the curved face, as described above, but this preliminary treatment is not essential but could be omitted, if necessary.

The redrawing treatment is so repeated once more that the bottomed cylindrical portion 113 is reduced to a diameter (e.g., about 28 mm) substantially equal to that of the neck portion 104. By repeating such drawing treatments, the portion corresponding to the shoulder portion 3 is shaped into the original curved face and a plurality of tapered faces leading to that curved face. The portion of the shoulder portion 3 having a provisional shape, in which those tapered faces continue, is pushed and stretched by a pair of shaping tools (i.e., a dies 118 and a pusher 117) having a shape of a virtual curved face extending from that curved face. This is the re-shaping (or reforming) treatment, by which the shoulder portion 3 is shaped into a continuously smooth surface as a whole.

Although the two redrawing treatments are performed in the specific example being described, a redrawing treatment of redrawing the bottomed cylindrical portion of a small diameter into one of a smaller diameter may be performed once if the contour of the neck portion 104 to be formed has about one half or more of the body diameter (e.g., 65.9 mm in this example) of the can. If the neck portion intended has an external diameter of about 38 mm, for example, the once redrawing treatment is sufficient.

After this, the twice mouth drawing treatments (for reducing the diameter of the upper half of the neck portion and the upper one quarter of the neck portion) are executed on the neck portion 104 shaped in the bottomed cylindrical shape, although not shown in FIG. 3.

The can 102 thus top-domed is subjected to a treatment for removing the lubricant, as shown in FIG. 2. At this lubricant removing step, the lubricant, e.g., normal butyl stearate, fluid paraffin or synthetic paraffin, as applied to the inner and outer surfaces of the can 102, is rinsed away by spraying a well-known degreasing agent and water or hot water, for example, to the inner and outer surfaces of the can 102. Alternatively, the can 102 is heated to a temperature as high as 200 to 300° C., (preferably 255 to 300° C.) to volatilize away the lubricant. Here, the lubricant having adhered to the inner surface of the can 102 need not always be removed at this stage, but the lubricant having adhered to the outer surface of the can has to be removed without fail so that it may not be an obstacle to the later printing/painting step.

When the lubricant is to be removed by the so-called "rinsing method", it is possible to employ the can washer which is adopted at the degreasing/rinsing step in the manufacture of the drawn/ironed can of the prior art. When the lubricant is heated to a high temperature so that it may be volatilize away, on the other hand, the can 102 may be carried on the net conveyor with its open portion being directed downward, and a hot wind (or a hot air) may be blown onto the can 102 being conveyed.

Where the thermoplastic resin film layer is made again amorphous at the lubricant removing step, the hot wind may be set to a temperature higher than the melting point of that thermoplastic resin, and a cold wind (at 20° C. or lower, or preferably 15° C. or lower) may be blown after the hot wind to quench the thermoplastic resin.

After the top doming step, the can 106, from which the lubricant has been removed at least from the outer surface, is transferred to the trimming step. At this trimming step, the body portion 105 is trimmed at its open lower end portion so that the can 106 is cut to a predetermined length. After this, the can 106 is transferred to the printing/coating step.

At this printing/coating step, though it is not shown in the FIG., there can be used a suitable apparatus for applying the print/coat to the outer surfaces of the cylindrical body portions by fitting (or crowning) the known two-piece cans (i.e., can bodiless before the end sheets are fixed thereto) on mandrels installed equidistantly in the circumferential portion of the rotary member of a known dry offset printing/coating apparatus, and by conveying the cans on the mandrel being moved as the rotary member rotates. The apparatus of this kind is disclosed, for example, in Japanese Patent Laid-Open Nos. 48-58905 (corresponding to U.S. Pat. No. 3,766,851), 52-41083 (corresponding to U.S. Pat No. 4,048,917), 54-92810, 57-170758 and 57-1787504.

Figure 4:
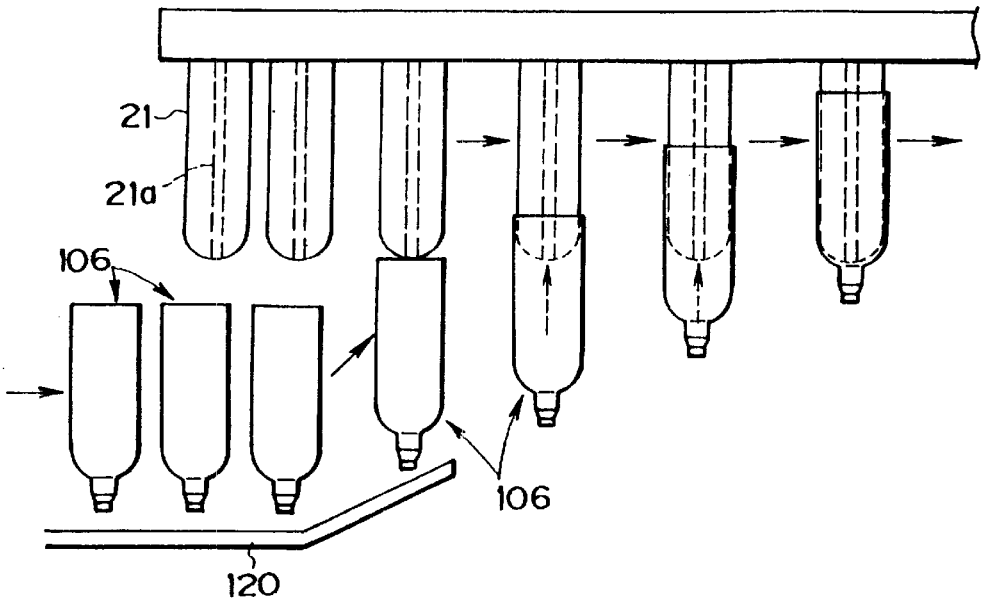
FIG. 4 is a conceptional diagram showing a mechanism for transferring a can to a mandrel of a printing/coating apparatus in a printing/coating step of the process shown in FIG. 2.
Figure 5:
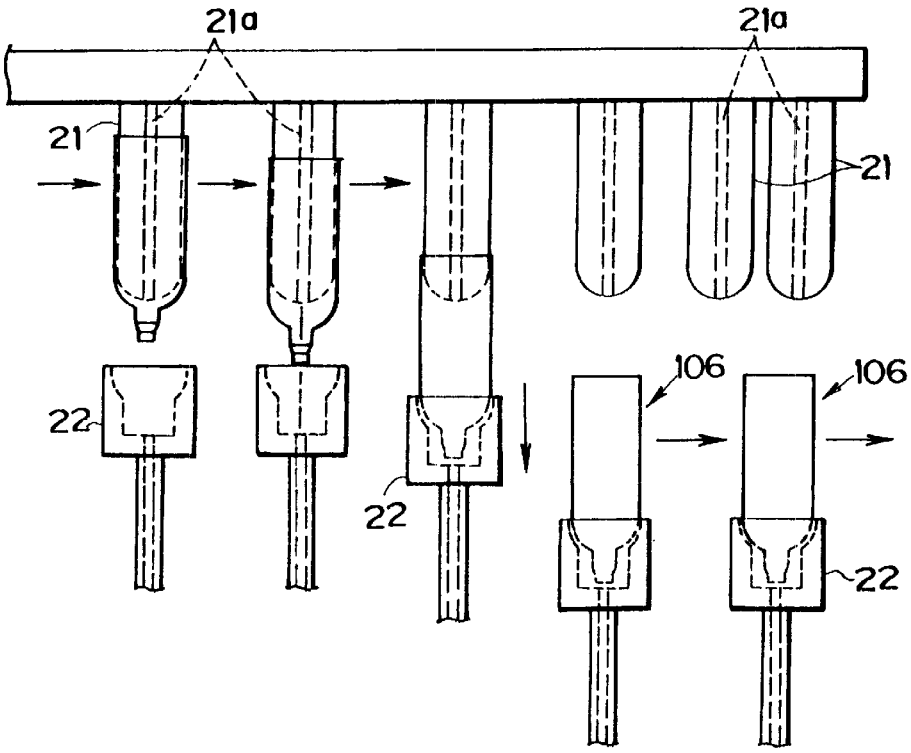
FIG. 5 is a conceptional diagram showing a mechanism for receiving the can from the mandrel.

FIGS. 4 and 5 show the state in which the cans are fed to and discharged from the mandrels of such printing/coating apparatus. At the not-shown feed station, the cans 106 being continuously fed in a suitable position not having the bottom end fixed yet are arrayed at a predetermined interval by the suitable means such as a screw and are distributed one by one in the (not-shown) pockets of a turret. As shown in FIG. 4, the cans 106 are brought close to mandrels 21 by a guide 120 and are then intermittently pushed one by one at a predetermined timing toward the mandrels 21 by a (not-shown) pusher so that they are fitted (or crowned) on the mandrels 21. Substantially simultaneously with or slightly before this, holes 21*a* formed along the center axes of the mandrels 21 are made to communicate with the vacuum source (although not shown) thereby to suck the cans 106 onto the mandrels 21 so that the cans 106 are completely fitted (or crowned) and held on the mandrels 21. Here, this pusher can be replaced by a construction in which the cans 106 are pushed by the compressed air timed to spurt.

On the other hand, the state of the cans at the discharge station is shown in FIG. 5. Specifically, vacuum pads 22 are gradually brought dose to the printed/coated cans 106 which are fitted on the mandrels 21. At the instant when the vacuum pads 22 have approached to some extent, the compressed air is injected from the holes 21*a* formed in the mandrels 21 so that the cans 106 are moved from the mandrels 21 toward the vacuum pads 22. Simultaneously with this, the cans 106 are sucked by the vacuum pads 22 so that they are sucked by the vacuum pads 22. In this state, the vacuum pads 22 are relatively retracted from the mandrels 21 so that the cans 106 are detached from the mandrels 21.

Here, the aforementioned fundamental mechanism for holding the cans 106 by the vacuum and for discharging the cans 106 by the injections of the compressed air, that is, the mechanism equipped with the mandrels and the vacuum pads having the air-communication holes formed along the center axes is similar to the mechanism in the apparatus of the prior art for the two-piece cans. However, the specific shapes of the mandrels 21 and the vacuum pads 22 are slightly modified in design for fitting the shape of the bottle-shaped cans. Specifically, the leading end portion of each mandrel 21 is shaped to abut against the lower portion of the inner surface of the portion corresponding to the shoulder portion 3 of the can 106, and the circumferential edge portion of each vacuum pad 22 is formed into such a largely inward recessed shape as to contact with the shoulder portion 3 of the can 106. Therefore, the vacuum pad 22 comes into close contact with the shoulder portion 3 of the can 106 to suck and hold the can 106 reliably.

The can 106 printed and having the top coating resin applied thereto is transferred from the printing/coating apparatus to suitable transfer means by the vacuum pad. This transfer apparatus is exemplified by a pinned conveyor (or a conveyor pin chain) called the "Deco pin chain", a flat belt conveyor having a number of holes, or a net conveyor. Where the pinned conveyor is employed, the can 106 is held by the pin inserted into and is conveyed into a dryer such as an oven. In this dryer, the can 106 is conveyed while vertically moving so that it is heated meanwhile to dry the printed ink layer and the top-coated layer sufficiently. Where the flat belt conveyor or the net conveyor is employed, the can 106 is placed with its opening being directed downward on the flat belt or the net moving in a horizontal direction. In this state, the can 106 is conveyed into the dryer such as the oven so that the printed ink layer or the top-coated layer is sufficiently dried by blowing a hot wind (a hot air) downward to the can 106 moving in the drier. A highspeed printing is made possible by employing a printer equipped with the vacuum suction mechanism and the compressed air injection mechanism thus far described.

At this drying step, the printed ink layer and the top-coated layer are dried. Simultaneously with this, the thermoplastic resin film (e.g., the mixed resin film of a polybutylene terephthalate resin and a polyethylene terephthalate resin) covering the inner and outer surfaces of the can 106 is made amorphous. This is effected by heating the can 106 to a temperature higher than the melting point of the thermoplastic resin film and by subsequently quenching the same. Thus, before the can 106 is delivered to the threading/curling step, there is improved the adhesion between the thermoplastic resin film and the aluminum alloy sheet or the material for the can 106.

Specifically, the thermoplastic resin covering layer, as formed on the metallic sheet or the material for the can 106, is made amorphous from the beginning but is crystallized as it passes through the shaping steps such as the cup shaping, the body shaping and the top doming steps. Therefore, in order to improve the adhesion between the thermoplastic resin covering layer and the aluminum alloy sheet or the material for the can 106 before the threading/curling step or a severe working step of the can 106, the aforementioned treatment for the amorphous state is made. Therefore, this treatment for the amorphous state may be made either simultaneously as the can is heated hot to volatilize the lubricant at the aforementioned lubricant removing step or by a separate apparatus for the amorphous state prior to the threading/curling step. If the can 106 is made amorphous according to the former method simultaneously as heated at the existing step before the threading/curling step, however, no special apparatus for the amorphous state need be provided so that the facilities can be simplified while improving the thermal efficiency.

As the means for printing the body portion of the can, there can be adopted not only the method of applying the dry offset print directly to the body portion of the can but also a method in which the body portion of the can is printed by heating and adhering such a printed polyester resin film to the outer surface of the body that a clear thermosetting coating containing a lubricant is applied to one side of a clear polyester resin film whereas a photogravure print and then an adhesive are applied to the other side and dried.

Such method and apparatus are disclosed in Japanese Patent Laid-Open Nos. 9-295639 (corresponding to EP-A2-0,808,706) and 10-683, for example.

What is disclosed in these Laid-Opens is a printed resin film applying apparatus comprising: a multiplicity of can fitting mandrels made rotatable on their axes and installed equidistantly in a diametral large disc-shaped rotary member; a high-frequency induction heating coil for heating the cans; means for cutting the printed long resin film to the length of one can (slightly longer than the circumferential length of the can); an application roll for sucking the printed film of the can length on its outer circumference and applying the film to the body portion of the heated can; and a pressure roll for pushing the printed film, as applied to the can body portion, to adhere it firmly to the body portion.

In these Laid-Opens, moreover, the following operations are disclosed. The cans are moved on their axes by a compressed air injection mechanism or the like so that they are fitted (or crowned) on the mandrels which are moved as the rotary member rotates. The cans are moved to predetermined positions of the mandrels by sucking them by the vacuum from the air holes of the mandrels. The printed film is thermally adhesioned to the circumference of the body portion of each can by an application roll and a pressure roll. After this, the compressed air is injected from the air hole of the fitting mandrel to discharge the can from the mandrel to the discharge conveyor. This discharge conveyor attracts and conveys the can by means of a magnet or vacuum.

In these Laid-Opens, still moreover, the mandrel is preheated so that the can may be heated, after fitted (or crowned) on the mandrel, to such a temperature as can adhere the adhesive applied to the printed film. After this, the printed film cut to the circumferential length of the body of one can is applied to the circumference of the can body.

If the above-mentioned method of thermally adhering the printed film to the body portion of the can is thus adopted as the printing means of the invention, the printing means of the resin film can be exemplified by the photogravure method which is more excellent in the printing clearness and in the expression of the gradation than the dry offset printing method. It is, therefore, possible to obtain a bottle-shaped can having a deep, luxury print appearance.

The can 106, which printed and top-coated at its body portion and the protective thermoplastic resin film of which is made again amorphous, is further shaped at the threading/curling step. At this step, the neck portion 104 is trimmed at first at its small diametrical upper end portion to open the neck portion 104. Next, the neck portion 104 thus opened is formed into a shape having an externally curled portion 11, a sloped wall 12, a threaded portion 13, a beaded portion 14 and a cylindrical portion 15 reduced in diameter, as shown in FIG. 1.

This shaping will be described more specifically. The neck portion 104 is trimed and opened at its diametrical small upper end portion, and the open end edge is then pre-curled slightly outward. With diess having a curved face of an arcuate section at its not-shown upper end circumferential edge being inserted into the inner side of the neck portion 104, moreover, a (not-shown) curling punch is pushed downward to form the externally curled portion at the open upper end edges of the neck portion 104 and the lower sloped wall into a curved face in which the longitudinal section is arcuately bulged.

After the curled portion 11 was thus formed, there is threaded the cylindrical wall which continues from the lower inclined wall of the curled portion 11. The method of forming the thread ridge and root is exemplified by the method, in which a (not-shown) female dies are inserted into the neck portion 104 and a (not-shown) roll is pushed from the outside onto the neck portion 104, or by the method in which a roll is pushed onto the inner side of the neck portion 104. After the thread was formed by either suitable method, a (not-shown) roll is pushed onto the outer surface of the lower portion to reduce it into a small diametrical cylindrical portion, with leaving a predetermined width below the threaded portion 13, to protrude the lower portion of the threaded portion 13 relatively thereby to form the annular beaded portion 14.

Here, this beaded portion 14 and the underlying reduced cylindrical portion 15 are so formed that a (not-shown) metallic cap (i.e., Pilfer proof cap) may be mounted in such a Pilfer proof state on the neck portion 4 by a (not-shown) capper as to apparently inform the fact that the cap is opened, from the broken perforations. When the cap is mounted on the neck portion 4, more specifically, the roller of the capper enters the reduced cylindrical portion 15 to deform the lower end wall (i.e., the lower end of the band-shaped portion below the breaking perforations) so that the lower end wall of the cap is pushed onto the lower side wall (or the lower step portion) of the beaded portion 14 thereby the cap is mounted firmly and reliably on the neck portion 4.

The can 106 thus having shaped the neck portion 4 is further transferred to the necking/flanging step, at which the open lower end portion of the body portion 105 on the side opposed to the neck portion 4 is sequentially necked in and flanged. At the subsequent bottom end seaming step, the separate bottom end 5 is double seamed by a seamer on the flanged portion formed at the open lower end portion of the can 106. Thus, there is manufactured the bottle-shaped can 1 which can be filled with a content of 500 ml. Here, the bottom end 5 is made of an aluminum alloy (JIS5182-H39) sheet which is covered inner side and outer side with the mixed resin films of a thickness of 0.02 mm the polybutylene terephthalate resin and the polyethylene terephthalate resin film by the thermal adhesion and which has a thickness of 0.285 mm and a diameter of 62.6 mm.

According to the bottle-shaped can manufacturing method of the invention thus far described, the metallic sheet having the protective covering film of the thermoplastic resin film formed on its surface and back is shaped with the lubricant applied thereon, to form the thinned body portion, the sloped shoulder portion and the unopened neck portion integrally so that the protective covering film (of the thermoplastic resin film layer) can be prevented in advance from being damaged by the friction with the shaping tool at the shaping time.

On the other hand, the thermoplastic resin film is adopted as the protective covering film for covering the metallic surface of the metallic sheet. At the threading/curling step after removing of the lubricant, therefore, the thermoplastic resin film layer functions the lubricant and extends and bends following the extending and bending of the metallic sheet so that the protective covering film neither breaks nor peels off. As a result, the covering state with the protective covering film can be satisfactorily kept even after the shaping of the can is completed. This makes it possible to give a sufficient corrosion resistance to the can which is provided with a portion difficult to coat at a later step, such as the inner surface of the threaded neck portion of a small diameter or the shoulder portion which is abruptly reduced in the diameter.

According to the method of the invention, on the other hand, the outer surface of the body portion is printed and top-coated at the printing/coating step subsequent to the lubricant removing step, so that it can be printed in an excellent state with the pattern. At this printing/coating step, moreover, the neck portion is not opened yet, and the can is closed at its one end side (i.e., at the side of the neck portion) so that the feed and discharge of the can to and from the printing/coating apparatus can be effected by converting the transfer means which is used in the prior art, as equipped with the vacuum and compressed air injection mechanism. Specifically, the printing/coating apparatus of the prior art for the two-piece cans can be employed merely by slightly modifying the shapes of the mandrels, the vacuum pads and the push members or the like for fitting (or crowning) the cans. Therefore, it is possible to effect the high-speed printing equivalent to that of the prior art for the two-piece cans.

Moreover, the vacuum can also be employed when the cans 106 are transferred from the printing/coating apparatus to the drying oven, so that even tall cans can be stably transferred without any fall.

Here in the specific example thus far described, at a previous step (e.g., at least either of the drying step or the lubricant removing step) before the threading/curling step, the thermoplastic resin film layer (e.g., the mixed resin film of the polybutylene terephthalate resin and the polyethylene terephthalate resin) covering the inner and outer surfaces of the can is heated to the melting point or higher and is then quenched to be made amorphous again and to improve the adhesion between the thermoplastic resin film and the metallic sheet. At the subsequent threading/curling step, therefore, the protective covering film of the thermoplastic resin film can be reliably prevented from peeling off.

In the aforementioned specific example, still moreover, the shoulder portion and the unopened neck portion are shaped in the following manners. The can is preformed at its bottom corner portion into the curved face and then at its bottom portion into the bottomed cylindrical shape. By using the unwrinkling tool having the tapered face of the sectionally straight shape approximating the arcuate section of the virtual curved face leading from the preformed curved face, the bottom portion formed into the aforementioned bottomed cylindrical shape is repeatedly drawn to shape the unopened neck portion of a small diameter. After this, the shoulder portion formed of the plurality of tapered faces into the shape approximating the curved face is pushed and re-shaped into the continuous smooth curved face. Therefore, the shoulder portion can be shaped into the smooth, fine domed face without any shaping mark.

Although one specific example of the bottle-shaped can manufacturing method of the invention has been described, the invention should not be limited to the specific example. For example, the metallic sheet for the material should not be limited to the aforementioned aluminum alloy sheet but could employ a surface-treated steel sheet, as subjected to various metal plating treatments or conversion coating treatments employed for the can manufactures, such as an extremely thin tin plated steel sheet, a nickel plated steel sheet, an electrolytic chromate treated steel sheet or a zinc plated steel sheet and others.

On the other hand, the thermoplastic resin film for covering the two sides of the metallic sheet can be exemplified suitably either solely or by a mixture of two kinds or more: an olefin resin such as polyethylene, polypropylene, a copolymer of ethylene-propylene, modified olefin; a polyester resin such as polyethylene terephthalate, polybutylene terephthalate, polyethylene naphthalate, a coplymer of ethylene terephthalate/isophthalate, a copolymer of ethylene terephthalate/adipate, a copolymer of butylene terephthalate/isophthalate, a coplymer of ethylene naphthalate/terephthalate; a polycarbonate resin; and a nylon resin. On the other hand, the covering mode should not be limited to the foregoing example of the single layer but can be a construction of a plurality of layers of different kinds of combined resins.

In the aforementioned specific example, on the other hand, there is employed the covering metallic sheet on which the thermoplastic resin coating layer is made amorphous. In the invention, however, the covering metallic sheet may be replaced by one in which bi-oriented crystals are left on the upper layer side of the thermoplastic resin covering layer. In the specific example, on the other hand, the thermoplastic resin covering layer is made amorphous at either of the drying step or the lubricant removing step. In this case, the covering layer need not to be made completely amorphous, but the oriented crystals may be left on the upper layer side of the covering layer.

Moreover, the method to be adopted for shaping the cup into the bottomed cylindrical can is exemplified by the aforementioned shaping method, in which the can body is made thinner at its circumferential wall than at its bottom portion by performing at least one ironing step after the redrawing treatment after one or more thinning treatments to bend and extend at the redrawing treatment were done. Then, the amount of the metallic sheet to be used for the material can be made as little as possible so that the damage to the thermoplastic resin covering the metallic sheet can be made as little as possible. In the invention, however, the shaping thus far described can be effected, too, not only by the aforementioned method but also by a shaping method in which one kind or two or more kinds of the drawing treatment, the ironing treatment, the drawing/ironing treatment, the redrawing treatment and the bending/extending treatment are selectively combined.

Still moreover, the shape or the shaping method of the shoulder portion in the invention should not be limited to those, in which the entire shoulder portion is formed into a smooth curved face, as exemplified in the foregoing specific example, but may be effected by a suitable manner to form a suitable shape in which the shoulder portion is stepped. On the other hand, the shape of the neck portion, as made at the threading/curling step, should not be limited to that which is exemplified by the foregoing specific example, but can be modified into a suitable one if the curled portion and the threaded portion are formed.

Moreover, the decoration to be applied to the outer surface of the body portion of the bottle-shaped can should not be limited to the direct printing on the outer surface of the body portion, as exemplified in the foregoing specific example, but may be made decorated by laminating the printed resin film on the outer surface of the body portion by the thermal adhering method. Where the printed resin film is thus adhered to the outer surface of the body portion, this adhesion can be satisfactorily made with the lubricant being removed so that the feed and discharge of the can to and from the film adhering apparatus can be performed by the transfer means using the vacuum mechanism. This action/effect is not different from that of the case in which the outer face of the body portion is directly printed.

Here will be described another method according to the invention. The method to be described is made to extend the decoration region is enlarged to the shoulder portion by decorating the bottomed cylindrical can 102 before the top doming step. On the other hand, the can to be treated by the following method is similar to the bottle-shaped can 1 described in the foregoing specific example, and the region to which the decoration 6 can be applied is hatched in FIG. 6.

Figure 6:
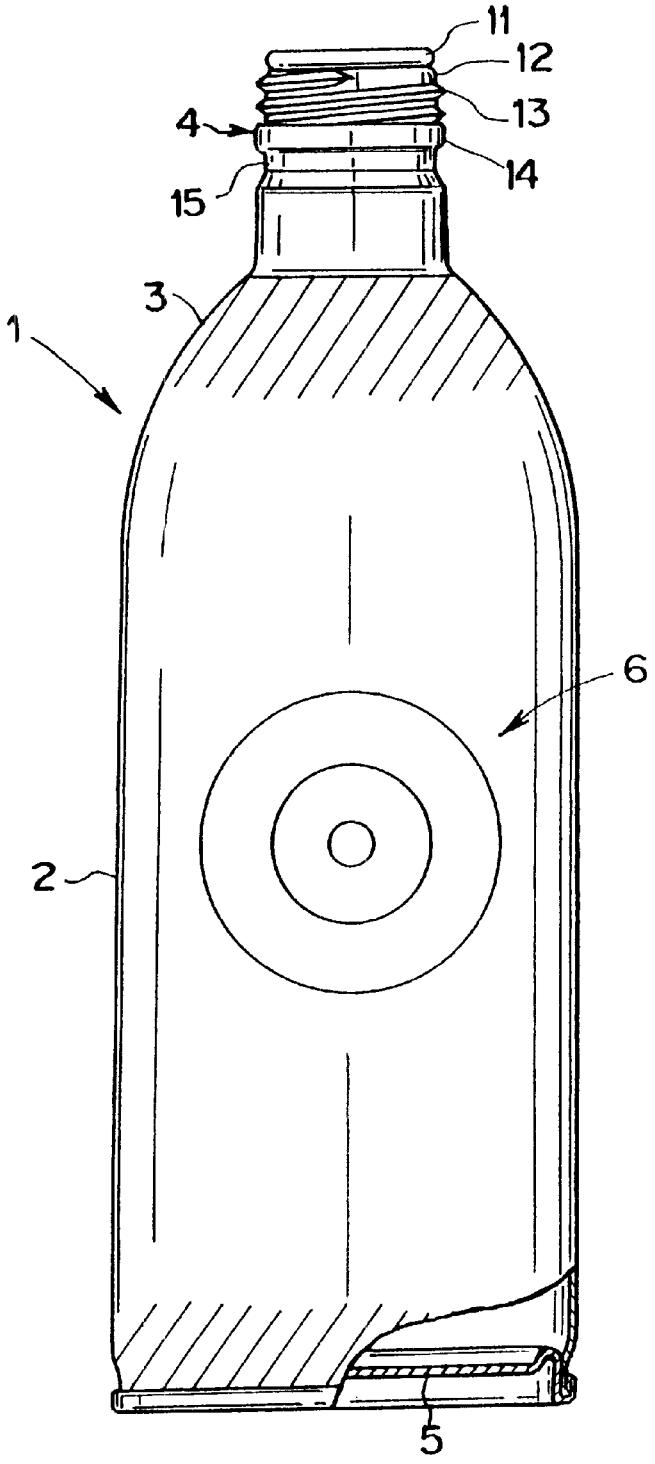
FIG. 6 is a partially sectional side elevation showing one example of a printed bottle-shaped can manufactured by another method according to the invention.
Figure 7:
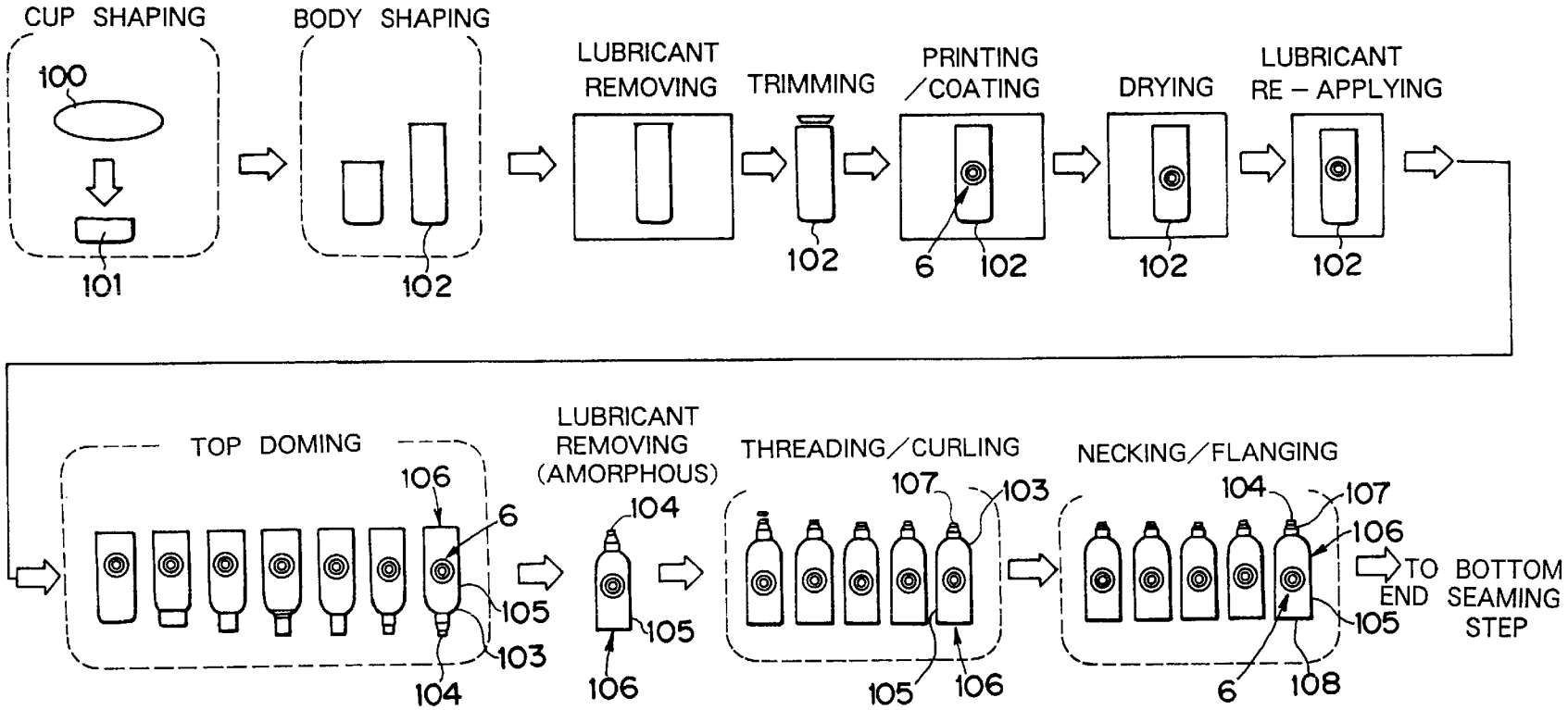
FIG. 7 is a process diagram for explaining a manufacture process for manufacturing the bottle-shaped can shown in FIG. 6.

FIG. 7 schematically shows a process for manufacturing the bottle-shaped can shown in FIG. 6. In the shown method, too, the used material is a covered metallic sheet which is prepared by forming the thermoplastic resin covering layer in the amorphous state on the surface and back of the metallic sheet and by applying the high-temperature volatile lubricant to the two sides, as in the foregoing example described with reference to FIG. 2. At a first step or a cup shaping step, moreover, the blank 100, as punched out in a disc shape from the covered metallic sheet, is drawn to shape the cup 101. At a next body shaping step, the cup 101 is redrawn at least one time to shape the bottom cylindrical can 102 thinned to have a small diametrical body.

These cup shaping step and can body shaping step are identical to those of the foregoing specific example. In the example being described, the lubricant is removed subsequent to the can body shaping step. At this lubricant removing step, the bottomed cylindrical can 102 is heated to remove the lubricant in an amount to raise no problem in the adhesion of the printing ink at least from the outer surface of the can 102. At a subsequent triming step, the can 102 is trimmed at its opened end side, to set the can 102 to a predetermined length, and the can 102 is transferred to the printing/coating step like that of the case of the two-piece can of the prior art.

At this printing/coating step, moreover, the can 102 is moved to and fitted on the corresponding one of the mandrels of the (not-shown) printing/coating apparatus by the known compressed air injection mechanism or push mechanism which is installed outside of the mandrels. After this, the can 102 is sucked and moved to a predetermined position by the vacuum mechanism mounted in the mandrel. In the printing/coating region, the can 102 is printed at its cylindrical body portion 105 with the desired decoration 6, to which the thermosetting resin is applied as the top coating layer. At the subsequent drying step, moreover, there are sufficiently dried the printed ink layer of the decoration 6 and the top coating layer formed over the former.

To the bottomed cylindrical can 102 thus printed and top-coated at its body portion 105, there is applied again the high-temperature lubricant at a lubricant re-applying step. At a subsequent top doming step, the bottomed cylindrical can 102 is preformed at first at its bottom corner portion (including the bottom portion and the body portion near of the former) covering the printed portion of the body portion 105, into an arcuate shoulder face in the longitudinal section, and is then drawn at its bottom portion several times to shape the shoulder portion 103 and the unopened neck portion 104. In the example shown in FIGS. 7 and 8, the can 102 is drawn three times.

After this, the shoulder portion 103, as drawn several times to have the annular step portion, is re-shaped into a dome shape to have the domed smooth shoulder portion 103 and the unopened small diametrical cylindrical neck portion 104, and this neck portion 104 is drawn two times at its upper portion Next, at the lubricant removing step, the can 106 is heated to remove the lubricant and is quenched to make the thermoplastic resin covering layer amorphous.

At a threading/curling step, the leading closed portion of the unopened neck portion 104 is then trimmed to open the neck portion 104, and this opened end portion is curled while being widened outward, to form an annular curled portion. Moreover, the cylindrical circumferential wall forming the neck portion 104 is threaded at 107 for fastening the cap is beaded below the thread 107.

At a necking/flanging step, still moreover, an open lower end portion 108 on the other side of the neck portion 104 is sequentially necked-in and flanged. At a not-shown bottom end seaming step, moreover, a bottom end of a separate member of a metallic sheet is integrally fixed on the open lower end portion of the body portion by a double seaming method using a seamer (or a can cover seaming machine). Thus, there is completed the bottle-shaped can 1 in which not only the cylindrical body portion but also the domed shoulder portion are printed with a designed decoration, as shown in FIG. 6.

Here will be described in more detail the method for manufacturing the bottle-shaped can shown in FIG. 7. The raw material or the metallic sheet is similar to that employed in the foregoing specific example and is prepared to have a thickness of 0.1 to 0.4 mm by laminating a thermoplastic resin film of polyester resin or polypropylene resin in advance on the two sides of an aluminum alloy sheet. Specifically, the covered metallic sheet employed is prepared by laminating a mixed resin containing a polybutylene terephthalate resin (PBI) and a polyethylene terephthalate resin (PET) (PBT:PET=60:40) with a thickness of 20 $\mu$m on the inner side and a thickness of 20 $\mu$m on the outer side of an aluminum alloy sheet 3004H191 defined by the Japanese Industrial Standards (JIS) and having a thickness of 0.315 mm.

The method of laminating the thermoplastic resin film on the metallic sheet and the method of making the laminated resin film amorphous are identical to those which have been described in connection with the first specific example. On the other hand, the lubricant to be applied to the thermoplastic resin film layers on the two surfaces of the covered metallic sheet is preferred to be the high-temperature volatile one, as exemplified in the first specific example.

By employing the covered metallic sheet, the bottomed cylindrical can is shaped as in the cup shaping and the can body shaping in the aforementioned specific example. To the metallic sheet having the thermoplastic resin film layers formed on its two sides, more specifically, there is applied as the lubricant one kind or two or more kinds of normal butyl stearate, fluid paraffin, petrolatum, polyethylene wax, food oil, hydrogen-added food oil, palm oil, synthetic paraffin or dioctyl sebacate. At the cup shaping step, the blank for each can is punched from the covered metallic sheet to which that lubricant has been applied. This blank is drawn into the cup shape. For example, the blank, as punched into a disc having a diameter of 170 mm, is drawn into a cup shape having a height of 48.3 mm and an external diameter of 100 mm.

At the subsequent body shaping step, the shaped cup is further redrawn two times. The shaped cup is bent/extended at the first redrawing step and is ironed at the second redrawing step. Thus, there is shaped a bottomed cylindrical can which has a smaller diameter but a larger height than the cup and which has a thinned body portion.

In the method shown in FIG. 7, the lubricant is removed in place of the top doming of the bottomed cylindrical can. At this lubricant removing step, the lubricant, e.g., normal butyl stearate, fluid paraffin or synthetic paraffin, as applied to the inner and outer surfaces of the can 102, is rinsed away by spraying a well-known degreasing and water or hot water, for example, to the inner and outer surfaces of the can 102. Alternatively, the can 102 is heated to a temperature as high as 200 to 300° C. (preferably 255 to 300° C.) to volatilize away the lubricant. The method of volatizing and removing the lubricant by heating it to the high temperature is preferable for the lubricant removing method because it is advantageous in that no drainage is contaminated with the lubricant thereby to require no facilities therefor.

Here, the lubricant having adhered to the inner surface of the can 102 need not always be removed at this stage, but the lubricant having adhered to the outer surface of the can has to be removed without fail so that it may not be detrimental to the later printing/coating step.

When the lubricant is to be removed by the so-called "rinsing method", it is possible to employ the can washer which is adopted at the degreasing/rinsing step in the manufacture of the drawn/ironed can of the prior art. When the lubricant is volatilize away, on the other hand, the can 102 may be carried on the net conveyor with its open portion being directed downward, and a hot wind (or a hot air) may be blown onto the can 102 being conveyed.

At the trimming step subsequent to the aforementioned removal of the lubricant, the can is trimmed at its open end side to adjust its height (i.e., the length in the cylindrical axial direction). Specifically, the cup having a height of 48.3 mm and an external diameter of 100 mm, for example, is shaped into the bottomed cylindrical can having a height of 171.5 mm or more and an external diameter of 65.9 mm and is trimmed to have an adjusted height of 171.5 mm.

The bottomed cylindrical can 102 thus cleared of the lubricant from its outer surface and having its height adjusted is sent to the printing/coating step. At this printing/coating step, there can be used the (not-shown) suitable apparatus which has been employed in the prior art for printing/coating the outer surface of the cylindrical body portion of a two-piece can (i.e., the can body before the end sheet is fixed thereto) being carried by the mandrel sequently. In absolutely the same state as that of the two-piece can of the prior art, moreover, the cylindrical body portion can be printed and top-coated on its outer surface. The apparatus of this kind is disclosed, for example, in Japanese Patent Laid-Open Nos. 48-58905 (corresponding to U.S. Pat. No. 3,766,851), 52-41083 (corresponding to U.S. Pat. No. 4,048,917), 54-92810, 57-170758 and 57-178754.

Here, the portion of the body portion of the bottomed cylindrical can in the vicinity of the bottom portion is re-shaped into the shoulder portion by the drawing treatment at the subsequent top doming step. When that portion is re-shaped into the shoulder portion, therefore, the portion of the nearer of the bottom portion has the smaller length in the circumferential direction so that the printed decoration pattern is influenced to have the smaller width in the circumferential direction as the body portion comes to the closer to the bottom portion. Therefore, this fact has to be considered into the shape of the portion (to become the shoulder portion) in the vicinity of the bottom portion in the decoration to be printed on the outer surface of the body portion of the can.

When the portion of the body portion of the bottomed cylindrical can in the vicinity of the bottom portion is re-shaped through the top doming step into the shoulder portion, the portion (or region) closer to the body portion than the center of the shoulder portion has different circumferential lengths between the portions adjoining in the axial direction. Therefore, either the long letters or sentences or the patterns repeated in the longitudinal direction may change in the thicknesses of the letters or the widths of the patterns between the neck portion side and the body portion side, and the intended design may not be obtained. In that portion (or region), on the contrary, no prominent difference arises either in the deformation in the circumferential direction or in the extension of the material to reduce the possibility that any special deformation may occur in the design of the circumferential continuous letters or patterns.

In the portion (or region) closer to the neck portion from the center of the shoulder portion, however, due to the anisotropy of the metallic sheet constructing the can body, there may occur a difference in the circumferential deformation or in the extension of the material. As a result, the sizes of the letters or patterns may lack unity even if the sentences are laterally written or if the patterns are circumferentially repeated. In this portion (or region), therefore, the design is preferably composed of one ground color, a simple density pattern, a simple geometric pattern, a simple pattern kind of having a plurality of clouds floating in a blue sky, or a document having a small number of (e.g., 1 or 2) letters.

For such a portion in the vicinity of the bottom portion of the body portion as corresponds to the portion of the shoulder portion closer to the body portion, therefore, designs of sentences or patterns other than long sentences or longitudinally repeated patterns can be selected to prevent the sentences or patterns from being distorted on the curved face of the shoulder portion. For the portion of the shoulder portion closer to the neck portion, on the other hand, the printed designs of the aforementioned simple patterns or the words of a small number of letters can be selected to make the distortions of the patterns or letters of that portion inconspicuous. As a result, it is possible to give unity to the decoration such as the patterns which are applied to the shoulder portion and the body portion shaped at the top doming step.

The can 102 thus printed/coated is transferred to the dryer such as the oven so that the printed ink layer and the top coating layer overlying the former may be dried sufficiently. Specifically, the printed ink layer and the top coating layer are dried by blowing the hot wind to the can 102.

At this drying step and at the aforementioned lubricant removing step, the can 102 is heated so that the thermoplastic resin film can be made amorphous by making use of the heat of the hot wind. Specifically, this hot wind is set to a temperature higher than the melting point of the thermoplastic resin, and a cold wind (at 20° C. or lower, preferably 15° C. or lower) may be blown to quench the can 102 after the hot wind was blown.

The lubricant is applied again to the bottomed cylindrical can 102 having passed through the drying step. The lubricant to be employed can be exemplified by a liquid one such as normal butyl stearate, fluid paraffin or synthetic paraffin and others. This lubricant is applied to the surfaces of the can 102 by a lubricant applying apparatus (e.g., waxer) such as a spray apparatus or a rotary applying apparatus having an outer circumference made of felt.

Next, the shoulder portion 3 and the neck portion 104 are shaped at the top doming step. First of all, the bottomed cylindrical can 102 is preformed at its bottom corner portion (including the bottom portion and the body portion near the former) into the arcuate shoulder face in the longitudinal section. The subsequent shaping treatment is made by the aforementioned apparatus and procedure shown in FIG. 3. With the can bottom being directed upward, more specifically, the can bottom corner is unwrinkled with the unwrinkling tool (composed of the drawing dies 111 and the unwrinkling pusher 110) having a curved face to contact with the curved face of the portion corresponding to the shoulder portion 3 of the can 102 shown in FIG. 3. In this state, the can bottom portion is drawn by the drawing punch 112 into the bottomed cylindrical shape having a smaller diameter than that of the body portion 105.

Moreover, the unwrinkling tool (including the redrawing dies 115 and the unwrinkling pusher 114) which is equipped with the tapered face of the sectionally straight shape approximating the tangential line drawn to the arcuate longitudinal section of the virtual curved face leading from said curved face preformed at the portion corresponding to the shoulder portion 3 is used to unwrinkle the bottom corner portion of a bottomed cylindrical portion 113 of a smaller diameter formed on the bottom portion side of the can 102. The bottom cylindrical portion 113 thus newly drawn is further drawn (or redrawn) in this state into a bottomed cylindrical shape of a smaller diameter by a redrawing punch 116.

The redrawing treatment is so repeated once more that the bottomed cylindrical portion 113 is reduced to a diameter substantially equal to that of the neck portion 104. By repeating such drawing treatments, the original curved face of the portion corresponding to the shoulder portion 3 is shaped into the curved faces leading to each other and a plurality of tapered faces. The portion of the shoulder portion 3 having a tentative shape, in which those tapered faces continue, is pushed and stretched by a pair of shaping tools (i.e., the redrawing dies 118 and the unwrinkling pusher 117) having a shape of a virtual curved face extending from that curved face. This is the re-shaping (or reforming) treatment, by which the shoulder portion 3 is shaped into a continuously smooth face as a whole. In short, the entire shoulder portion is shaped into the curved face leading smoothly to the original curved face. Here, the neck portion 104 shaped into the bottomed cylindrical shape is drawn two times, although not shown in FIG. 3.

At the top doming step, the bottomed cylindrical can 102 is preformed at its portion near the bottom of the thinned body portion 105 into the curved face, and is then so top-domed (at its shoulder portion and its unopened neck portion) that the preformed portion may form a part of the shoulder portion. In order that the preformed portion may not be wrinkled at the top doming step, at the can body shaping step of shaping the cup 101 into the bottomed cylindrical can 102, the thickness of the portion (i.e., the side wall portion near the can bottom) of the body portion 105 to be preformed is desired to be 60% or more of the sheet thickness (substantially equal to the sheet thickness of the metallic sheet before worked) of the can bottom.

Figure 8:
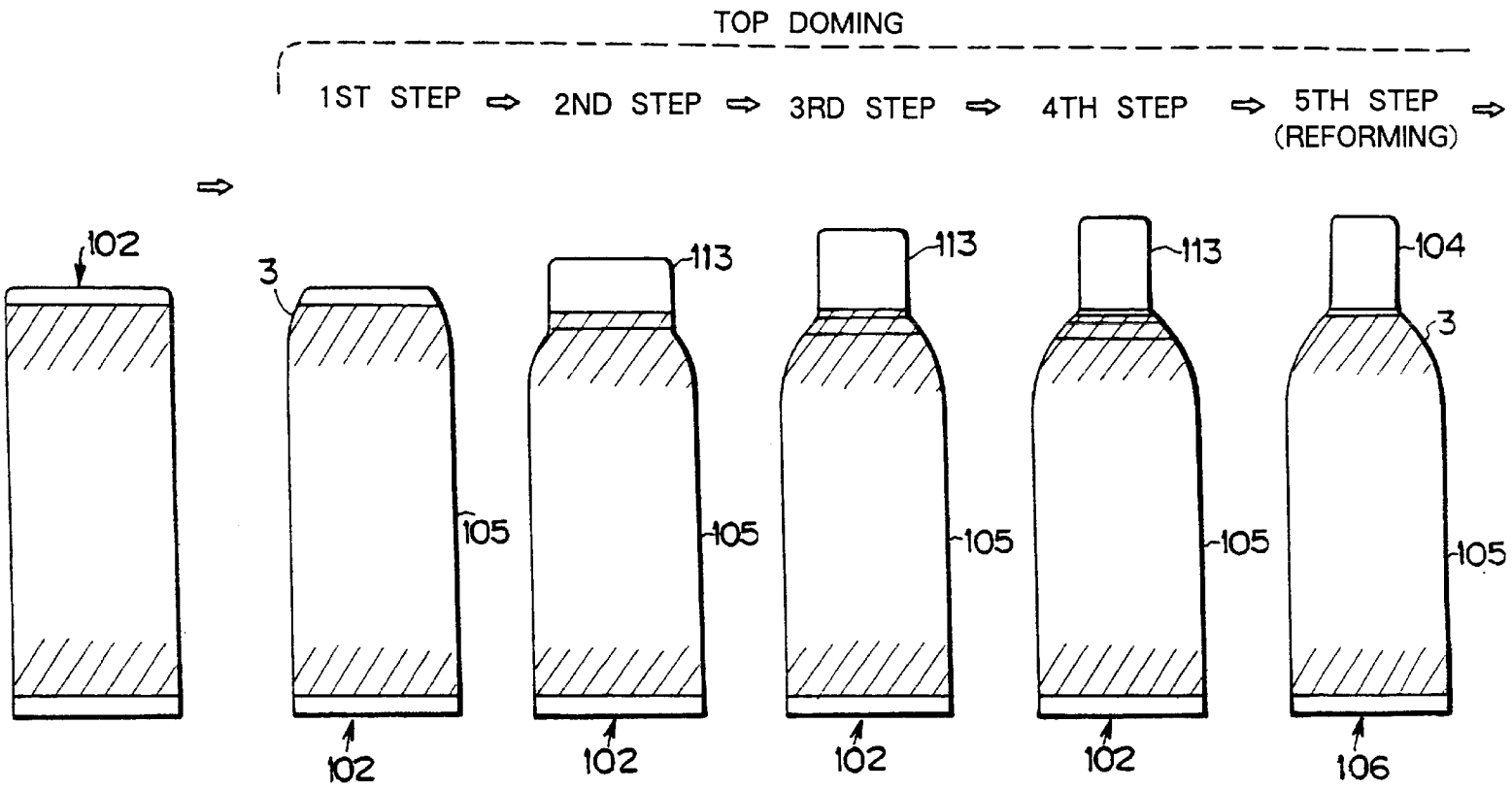
FIG. 8 is an explanatory diagram showing a printed region of a can at the individual stages of the top doming step of the bottle-shaped can.

The changes in the shape at the top doming step thus far described are shown in FIG. 8. Here, the portions hatched in FIG. 8 are regions to be decorated by the printing or the like as in FIG. 6.

Before the drawn neck portion 104 is threaded/curled, the lubricant is removed. This lubricant was applied by the lubricant applying apparatus (or waxer) before the aforementioned top doming step. For this removal, the lubricant may be volatilized, for example, by heating the can 106 to a high temperature. Then, it is possible to prevent the drain from being contaminated with the lubricant.

In this case, the thermoplastic resin film (e.g., the mixed resin film of the polybutylene terephthalate resin and the polyethylene terephthalate resin) covering the inner and outer surfaces of the can 106 is heated to a temperature higher than its melting point and is quenched to an amorphous state. This improves the contact between the resin film and the aluminum alloy sheet.

Here in the method shown in FIG. 7, either at the lubricant removing step after the can body shaping step or at the drying step after the printing/coating step, the thermoplastic resin film layer is heated and quenched to the amorphous state. However, the thermoplastic resin film layer is extended again and crystallized at the subsequent top doming step so that it is made again amorphous at the lubricant removing step after the top doming step.

The thermoplastic resin film may be made amorphous before the threading/curling step by a separate heating/quenching apparatus. If the resin film is made amorphous simultaneously as the can 106 is heated to the high temperature to evaporate the lubricant, however, no special apparatus for the amorphous state need be provided so that the facilities can be simplified while improving the thermal efficiency.

Figure 9:
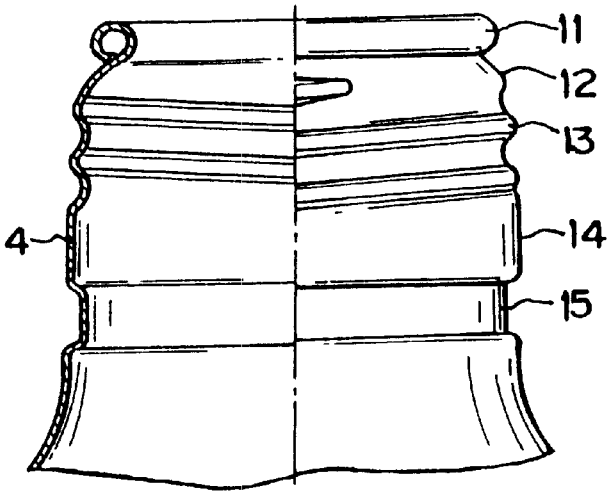
FIG. 9 is a partially sectional side elevation showing the neck portion of the bottle-shaped can manufactured by the method of the invention.

The threading/curling treatment of the neck portion 104 of the can 106, from which the lubricant is removed and the thermoplastic resin film layer of which is made amorphous, is performed as in the foregoing specific example which has been described with reference to FIG. 2. Here is omitted the description by showing the shape of the threaded/curled neck portion 4 in an enlarged scale in FIG. 9.

On the other hand, the open lower end portion of the can 102 whose neck portion 4 has been threaded/curled, is necked/flanged, and the bottom end is then attached to the open lower end portion, both being like those of the foregoing specific example which has been described with reference to FIG. 2, so that the repeated description will be omitted.

According to the bottle-shaped can manufacturing method of the invention thus far described, at the stage of the bottle-shaped can being shaped, the lubricant is removed, and the cylindrical body portion is printed on its outer surface, so that the outer surface of the can can be directly printed in absolutely the same state as that of the case in which the conventional two-piece can is manufactured. At the top doming step after the lubricant was applied again to the bottomed cylindrical can printed, on the other hand, the bottom corner portion (i.e., the bottom portion and the body portion near the bottom portion) of the bottomed cylindrical can is preformed into the curved face including the hatched printed region, and the bottom portion of the body portion, as hatched and included in the printed region, is shaped into a portion of the shoulder portion. Therefore, it is possible to enlarge the decoration region to the shoulder portion of the bottle-shaped can.

Here in the foregoing specific example of the invention, at the lubricant removing step before the threading/curling step, the thermoplastic resin film layer is made again amorphous to improve the contact between the thermoplastic resin film and the metallic sheet. Therefore, it is possible to prevent the peeling of the protective covering film (i.e., the thermoplastic resin film layer) at the subsequent threading/curling step.

In the specific example described with reference to FIG. 7, too, when the shoulder portion and the unopened neck portion are to be shaped, the can is preformed at its bottom corner portion into the curved face. The paired unwrinkling tools having the curved faces to contact the former curved face are used to draw the bottom portion into the bottomed cylindrical shape. Moreover, the unwrinkling tool having the tapered face of the sectionally straight shape approximating the arcuate longitudinal section of the virtual curved face leading from the preformed curved face is used to redraw the bottom portion shaped in the bottomed cylindrical shape, repeatedly thereby to shape the unopened neck portion of the small diameter. After this, the shoulder portion, as formed into the shape approximating the curved face by a plurality of tapered faces, is extended into the continuous smooth curved faces. Therefore, the shoulder portion can be shaped as a whole into the smooth, fine domed face without leaving any shaping mark. Where the neck portion to be shaped has a diameter as large as one half or more of the body portion diameter, one redrawing step is sufficient so that only one tapered face is formed on the shoulder portion.

Where the metallic sheet covered with the thermoplastic resin covering film layer is used as the material in the invention, it is preferable for improving the adhesiveness and the workability that the shaping treatment such as the cup shaping step, the top doming step or the threading/curling step is performed after the thermoplastic resin covering film layer is made amorphous, as exemplified hereinbefore. However, the invention should not be limited to the shaping treatment described above, but can be practiced by making not the entire thermoplastic resin film but only the lower layer side of the thermoplastic resin covering film layer amorphous and by performing the shaping treatment with the bi-oriented crystals being left on the upper layer side. Then, the covering film is inferior in the workability but superior in the corrosion resistance and the impact resistance to one which is made amorphous in its entirety.

Into the synthetic resin covering film on the outer surface of the can in the invention, moreover, there may be mixed a pigment or dye such as titanium dioxide, calcium carbonate, alumina or aluminum powder so as to hide the metallic color of the metallic sheet. In this case, the more mixed pigment will make the shapability the worse. It is, therefore, preferable that the printing employs the ink containing a small amount of white pigment.

In the invention, moreover, the bottomed cylindrical can is curved, when shaped, in the vicinity of the lower end of its body portion, if the region to be decorated by the printing or the like is confined within one half or less of the shoulder portion. Thus, it is possible to omit the step of preforming the bottom corner portion of the printed can into the curved face having an arcuate longitudinal section.

Figure 10:
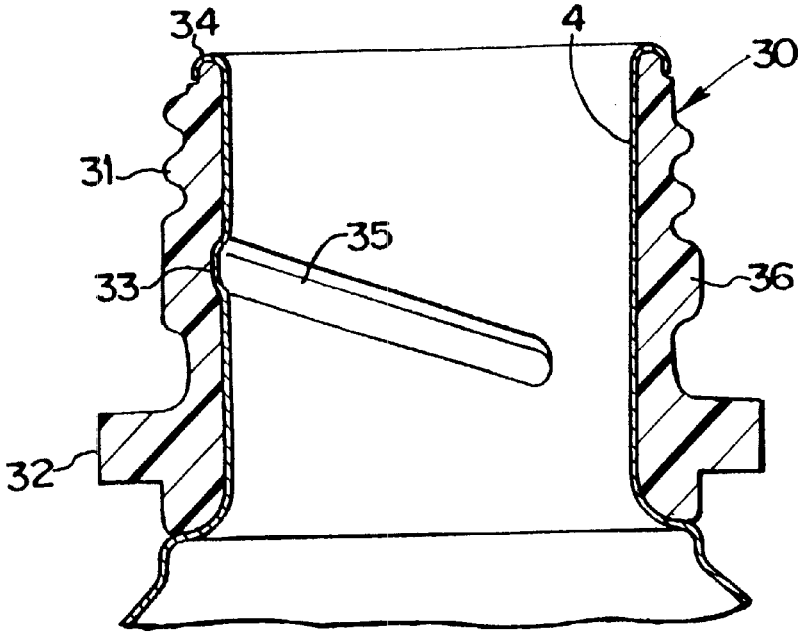
FIG. 10 is a longitudinal section showing a portion of an example in which a cylindrical member of a resin having a threaded portion and an annular bulge for fixing the tamper evidence band of a tamper evidence cap is fixed on the neck portion by working a smaller-diameter cylindrical portion of a bottle-shaped can.

In the invention, still moreover, the curled portion or the threaded portion need not be directly shaped at the neck portion, but a threaded cylindrical member of a synthetic resin may be fitted and fixed on the neck portion, for example, as shown in FIG. 10. Where the threaded cylindrical member of a synthetic resin is fixed on the neck portion, it is quite natural that the specific structure is not limited to that shown in FIG. 10.

Here will be described the structure shown in FIG. 10. A cylindrical body 30 is molded in advance of a resin such as polypropylene, polyethylene or polyester by the injection molding method and is provided with: a threaded portion 31 for fastening the cap; a beaded portion 36 for engaging with the lower end portion of a Pilfer proof cap; a retaining ring 32 for retaining the can at a content filing step or the like; and an inner surface recess 33 for preventing a relative turning motion between the neck portion 4 and the cylindrical body 30. This cylindrical body 30 is fitted on the neck portion 4 which has been trimmed and opened at its upper end. After this, the neck portion 4 is considerably pre-curled outward at its open edge, and the curling punch is then pushed down to curl the neck portion 4, so that the leading end of a curled portion 34 is caused to bite into the outer circumference of the upper end of the cylindrical body 30 to fix the upper end of the cylindrical body 30. After this, a liquid pressure or an elastic pressure is applied from the inside to the vicinity of the center of the neck portion 4 so that the side wall portion of the neck portion 4 at a position corresponding to the inner surface recess 33 of the cylindrical body 30 is bulged to form a bulging portion 35. As a result, the cylindrical body 30 is fixed without any relative turn to the neck portion 4.

Figure 11:
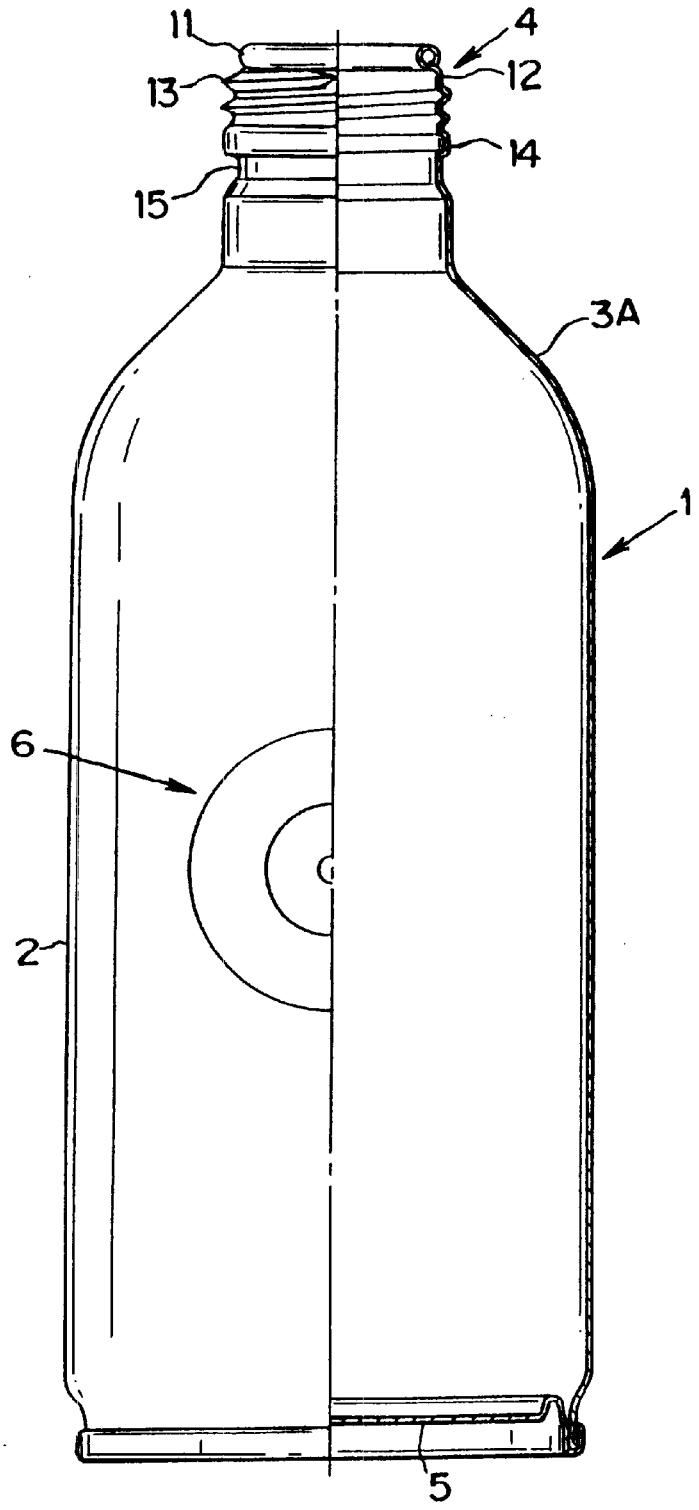
FIG. 11 is a partially sectional view showing another example of the bottle-shaped can manufactured by the method of the invention.

Moreover, the invention can also be applied to the case in which there is manufactured the bottle-shaped can having a shoulder portion of not a curved face but a tapered face of a longitudinally straight section unlike the bottle-shaped cans of the aforementioned individual specific examples. The shape of such a bottle-shaped can is shown in FIG. 11. In the bottle-shaped can 1, as shown, a shoulder portion 3A leading to the lower side of the neck portion 4 is so tapereded as has a gradually larger diameter on the lower side. From the tapereded shoulder portion, there leads a bulging portion, through which the can leads to the can body 2. Here, the structure of the can bottom is identical to those shown in the aforementioned individual specific examples.

The bottle-shaped can having the shape shown in FIG. 11 may be redrawn at the redrawing steps, or the second and third steps for the top doming treatment, as has been described with reference to FIG. 3, by using the paired unwrinkling tools: the unwrinkling pusher which is provided at its leading end portion with the sloped face having the generally straight longitudinal section approximating the tangential line drawn to the arcuate longitudinal section of the preformed curved shoulder face; and the redrawing dies which is provided with a similar sloped face at least at its portion to confront the pusher and which is provided at its portion on the leading end side from the sloped face with the bulging face having the arcuate longitudinal section. At the forth step, or the reforming step, on the other hand, there may be used the paired shaping tools (i.e., the dies and the pusher) having the individual tapered faces. At the top doming step for shaping the shoulder portion 3A and the neck portion 4, more specifically, the bottom corner portion of the bottomed cylindrical can 102 is preformed into the curved shoulder face having the arcuate longitudinal section. Next, the unwrinkling tool having the curved face to contact with the curved face of the portion corresponding to the shoulder portion 3A is used to unwrinkle the can bottom corner portion, and the can bottom portion is drawn in that state into the bottomed cylindrical shape having a smaller diameter than that of the body portion.

Moreover, the unwrinkling pusher and the redrawing dies, which are provided at their portions corresponding to the shoulder portion 3A with the sloped face having the straight longitudinal section approximating the arcuate longitudinal section of the virtual curved face leading from the preformed curved face, unwrinkled the bottom corner portion of the bottomed cylindrical portion 113 having a small diameter and being shaped at the bottom portion side of can 102. The bottomed cylindrical portion 113 thus newly drawn is shaped in that state into the bottomed cylindrical shape having a smaller diameter by the redrawing punch.

The redrawing treatment thus far described is repeated once more to reduce the bottomed cylindrical portion 113 to a diameter substantially equal to that of the neck portion 104. By repeating these drawing treatments, the original curved face of the portion corresponding to the shoulder portion 3A is shaped into the curved faces leading to each other and a plurality of tapered faces. The shoulder portion 3A, as tentatively shaped to have the continuous tapered faces, is pushed and extended by the paired shaping tools having the tapered faces of the straight section. This is the re-shaping (or reforming) treatment, by which the shoulder portion 3A is shaped into the straight tapered face leading to the body portion through the curved face. Here in this embodiment, the two redrawing treatments are performed, but only one redrawing treatment is sufficient if the neck portion to be shaped has an external diameter of one half or more of that of the body portion.

Figure 12:
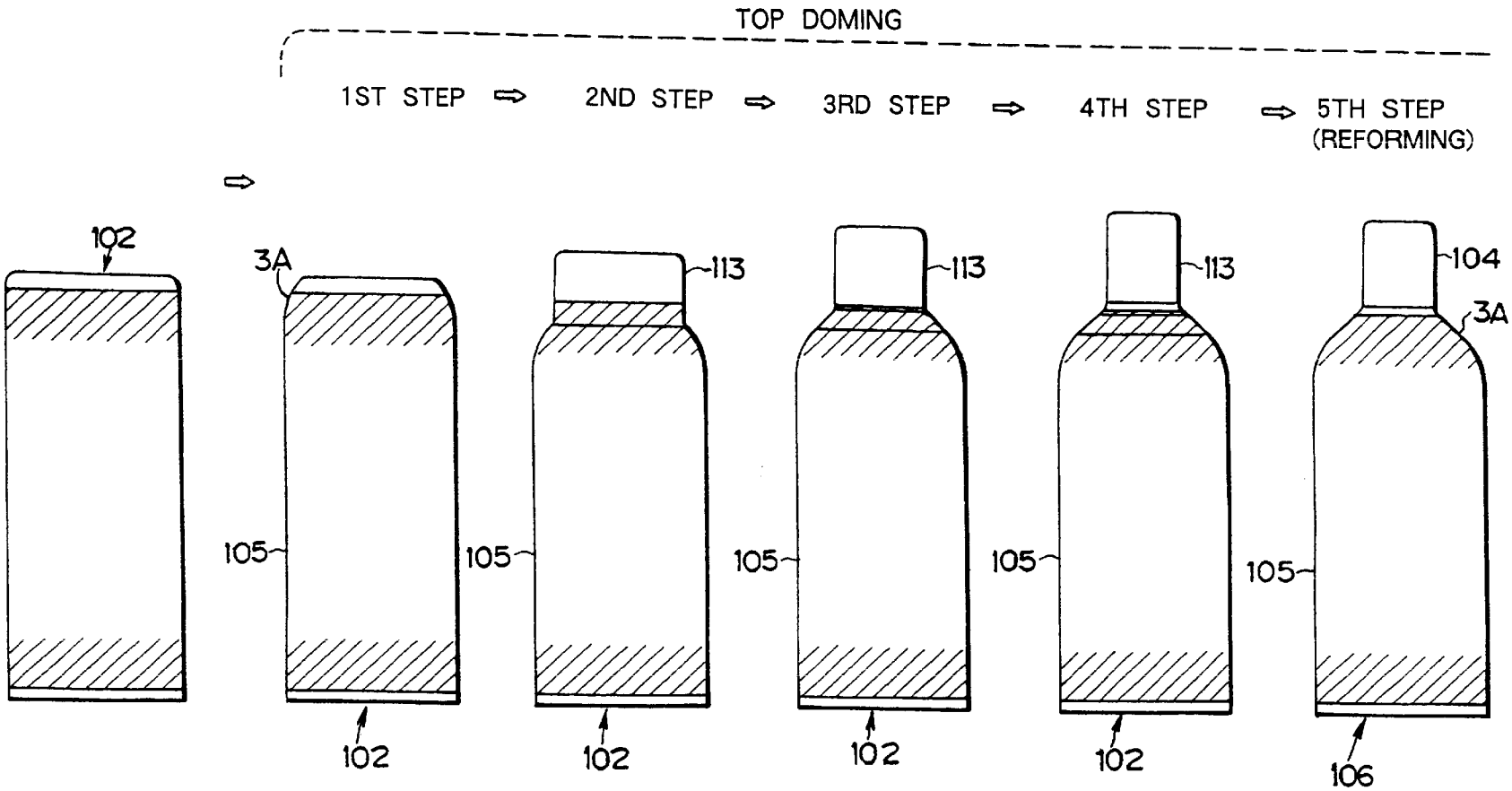
FIG. 12 is an explanatory view showing a shaped state of a neck portion and a shaped state of a shoulder portion sequentially at a top doming step in the process for manufacturing the bottle-shaped can shown in FIG. 11., in order.

The changes in the shapes at the shaping steps thus far described are shown in FIG. 12. The hatched portions of FIG. 12 indicate the printed regions.

According to the bottle-shaped can manufacturing method of the invention, as has been described hereinbefore, the metallic sheet having the protective covering film is shaped into the bottle shape by further applying the lubricant thereto. Therefore, the protective covering film can be homogeneously formed on the metallic surface of the bottle-shaped can which has the threaded neck portion of such a small diameter as it hard to coat later, and can also be given a sufficient corrosion resistance. After the shaping into the bottle shape, on the other hand, the lubricant is removed, and the outer surface is then decorated by the printing or the like. Therefore, the satisfactory decoration can be applied to the outer surface of the body portion without any abnormality such as the peeling or distortion. As the means for conveying or transferring the bottle-shaped can at the step of decorating it by the printing or the like, moreover, there can be converted the vacuum or compressed air injection mechanism which is used in the prior art in the process for manufacturing the two-piece can or the like. Therefore, it is possible to lower the cost for the facilities.

In the bottle-shaped can manufacturing method of the invention, on the other hand, the can is cleared of the lubricant at the stage of shaping the bottomed cylindrical shape and is decorated on the outer surface of its body portion by the printing or the like, followed by the shaping into the bottle shape. Therefore, the decoration can be directly applied by the printing or the like to the outer surface of the can in absolutely the same state as that of the case of the two-piece can of the prior art. Moreover, the range of the decoration applied to the outer surface of the can is not limited to the cylindrical body portion but can be extended to the shoulder portion.

INDUSTRIAL APPLICABILITY

According to the invention, there is provided a manufacturing method for the bottle-shaped can by using the metallic sheet as the material so that it can be utilized in the industrial field of manufacturing containers for various beverages including beer or carbonated beverages. Moreover, even the metallic can can be sealed up again with the cap and can be recovered like the general metallic can used, so that it can be highly utilized in the field of manufacturing the beverage cans.

What is claimed is:

1. A manufacturing method for a bottle-shaped can in which a small diametrical neck portion, a shoulder portion having a sloped face and a large diametrical body portion are integrally shaped, in which a decoration print is applied at least to the outer surface of the body portion and in which a bottom end is fixed on the lower end portion of the body portion, characterized by comprising:

a cup shaping step of shaping a covered metallic sheet, as prepared by forming thermoplastic resin covering films on the two surfaces of a metallic sheet and by applying a lubricant to the thermoplastic resin covering films, into a cup shape by punching out the metallic sheet;

a can shaping step of shaping the shaped cup further into a bottomed cylindrical can which is reduced in its diameter and thinned at its body portion;

a diametrical small cylindrical portion shaping step of shaping the bottom portion of said bottomed cylindrical can and the body portion in the vicinity of the bottom portion of it into said shoulder portion and an unopened small diametrical cylindrical portion;

an opening step of cutting and opening the leading end portion of said small diametrical cylindrical portion;

a neck portion shaping step of shaping the neck portion by threading the outer circumference of the opened small diametrical cylindrical portion;

a lubricant removing step of removing the lubricant from the outer surface of said bottomed cylindrical can, between the step of shaping said bottomed cylindrical can having the thinned body portion and the step of cutting and opening the leading end portion of said small diametrical cylindrical portion; and a decoration step of decoratively printing the outer surface of the body portion of said bottomed cylindrical can cleared of the lubricant, between the step of shaping said bottomed cylindrical can having the thinned body portion and the step of cutting and opening the leading end portion of said small diametrical cylindrical portion.

2. A manufacturing method for a bottle-shaped can as set forth in claim 1, characterized in that said lubricant removing step and said decoration step are executed between said small diametrical cylindrical portion shaping step and said opening step.

3. A manufacturing method for a bottle-shaped can as set forth in claim 2, characterized:

in that at said small diametrical cylindrical portion shaping step, said bottomed cylindrical can is preliminary molded at its bottom corner portion into a curved shoulder face of an arcuate longitudinal section and is then drawn at its bottom portion into a bottomed cylindrical portion of a smaller diameter than that of the body portion while the curved shoulder face of said bottom corner portion being unwrinkled by a pair of unwrinkling pusher and drawing dies having curved faces to contact with said curved shoulder face;

in that after this, an unwrinkling pusher, which is provided at its leading end portion with a tapered face having a generally straight longitudinal section approximating a tangential line drawn to an arcuate longitudinal section of a virtual curved face leading from a preformed curved shoulder face, a redrawing dies, which is positioned at a portion to confront at least said unwrinkling pusher and which is provided at its leading end portion with a tapered face having a generally straight longitudinal section approximating a tangential line drawn to an arcuate longitudinal section of a preformed curved shoulder face, and a redrawing punch are used to perform one or more redrawing treatments for reducing the diameter of said bottomed cylindrical portion of the small diameter diametrically, while the bottom corner portion of said bottomed cylindrical portion of the small diameter formed by the drawing treatment being unwrinkled, thereby to shape said bottomed cylindrical portion of the small diameter into a radially small cylindrical portion of substantially the same diameter as that of said neck portion; and in that after this, one or two or more continuing tapered faces formed between said small diametrical cylindrical portion and said curved shoulder face are extended and reshaped into a smooth curved face leading from said curved shoulder face by a pair of reshaping tools having a surface shape of a virtual curved face extending from said curved shoulder face, to form shoulder portion shape into a curved face of a domed longitudinal section.

4. A manufacturing method for a bottle-shaped can as set forth in claim 2, characterized:

in that at said small diametrical cylindrical portion shaping step, said bottomed cylindrical can is preliminary molded at its bottom corner portion into a curved shoulder face of an arcuate longitudinal section and is then drawn at its bottom portion into a bottomed cylindrical portion of a smaller diameter than that of the body portion while the curved shoulder face of said bottom corner portion being unwrinkled by a pair of unwrinkling pusher and drawing dies having curved faces to contact with said curved shoulder face;

in that after this, an unwrinkling pusher, which is provided at its leading end portion with a sloped face having a generally straight longitudinal section approximating a tangential line drawn to an arcuate longitudinal section of a virtual curved face leading from a preformed curved shoulder face, a redrawing dies, which is positioned at a portion to confront at least said pusher, which is provided at its leading end portion with a sloped face having a generally straight longitudinal section approximating a tangential line drawn to an arcuate longitudinal section of a virtual curved face extending from the curved shoulder face which is provided at its portion on the leading end side from said sloped face with a bulging face having an arcuate longitudinal section, and a redrawing punch are used to perform one or more redrawing treatments for reducing the diameter of said bottomed cylindrical portion of the small diameter, while the bottom corner portion of said bottomed cylindrical portion of the small diameter formed by the drawing treatment being unwrinkled, thereby to shape said bottomed cylindrical portion of the small diameter into a diametrical small cylindrical portion of substantially the same diameter as that of said neck portion; and in that after this, one or two or more tapered faces formed between said small diametrical cylindrical portion and said curved shoulder face are extended and re-shaped into a smooth sloped face leading from said curved shoulder face by a pair of re-shaping tools having a surface shape of a straight longitudinal section approximating a tangential line drawn to a virtual curved face extending from said curved shoulder face, to form the shoulder portion shape into a smooth curved face of a straight longitudinal section leading from the curved shoulder face.

5. A manufacturing method for a bottle-shaped can as set forth in claim 2, characterized:

in that said neck portion shaping step is to curl the leading end portion of said small diametrical cylindrical portion opened, to form a curled portion and to thread the cylindrical portion below said leading end portion directly to form a thread.

6. A manufacturing method for a bottle-shaped can as set forth in claim 2, characterized:

in that said neck portion shaping step is to fit a cylindrical member of a resin threaded in advance, on said small diametrical cylindrical portion and to bend the leading end portion of said small diametrical cylindrical portion opened, outward to bring the same into engagement with said cylindrical member of the resin.

7. A manufacturing method for a bottle-shaped can as set forth in claim 1, characterized:

by further comprising a lubricant applying step of applying a lubricant, immediately after said decoration step, at least to the outer surface of said bottomed cylindrical can; and in that said lubricant removing step and said decoration step are executed between said can shaping step and said small diametrical cylindrical portion shaping step.

8. A manufacturing method for a bottle-shaped can as set forth in claim 7, characterized:

in that at said small diametrical cylindrical portion shaping step, said bottomed cylindrical can is preliminary molded at its bottom corner portion into a curved shoulder face of an arcuate longitudinal section and is then drawn at its bottom portion into a bottomed cylindrical portion of a smaller diameter than that of the body portion while the curved shoulder face of said bottom corner portion being unwrinkled by a pair of unwrinkling pusher and drawing dies having curved faces to contact with said curved shoulder face;

in that after this, an unwrinkling pusher, which is provided at its leading end portion with a tapered face having a generally straight longitudinal section approximating a tangential line drawn to an arcuate longitudinal section of a virtual curved face leading from a preformed curved shoulder face, a redrawing dies, which is positioned at a portion to confront at least said unwrinkling pusher and which is provided at its leading end portion with a tapered face having a generally straight longitudinal section approximating a tangential line drawn to an arcuate longitudinal section of a preformed curved shoulder face, and a redrawing punch are used to perform one or more redrawing treatments for reducing the diameter of said bottomed cylindrical portion of the small diameter diametrically, while the bottom corner portion of said bottomed cylindrical portion of the small diameter formed by the drawing treatment being unwrinkled, thereby to shape said bottomed cylindrical portion of the small diameter into a radially small cylindrical portion of substantially the same diameter as that of said neck portion; and in that after this, one or two or more continuing tapered faces formed between said small diametrical cylindrical portion and said curved shoulder face are extended and reshaped into a smooth curved face leading from said curved shoulder face by a pair of reshaping tools having a surface shape of a virtual curved face extending from said curved shoulder face, to form shoulder portion shape into a curved face of a domed longitudinal section.

9. A manufacturing method for a bottle-shaped can as set forth in claim 7, characterized:

in that at said small diametrical cylindrical portion shaping step, said bottomed cylindrical can is preliminary molded at its bottom corner portion into a curved shoulder face of an arcuate longitudinal section and is then drawn at its bottom portion into a bottomed cylindrical portion of a smaller diameter than that of the body portion while the curved shoulder face of said bottom corner portion being unwrinkled by a pair of unwrinkling pusher and drawing dies having curved faces to contact with said curved shoulder face;

in that after this, an unwrinkling pusher, which is provided at its leading end portion with a sloped face having a generally straight longitudinal section approximating a tangential line drawn to an arcuate longitudinal section of a virtual curved face leading from a preformed curved shoulder face, a redrawing dies, which is positioned at a portion to confront at least said pusher, which is provided at its leading end portion with a sloped face having a generally straight longitudinal section approximating a tangential line drawn to an arcuate longitudinal section of a virtual curved face extending from the curved shoulder face which is provided at its portion on the leading end side from said sloped face with a bulging face having an arcuate longitudinal section, and a redrawing punch are used to perform one or more redrawing treatments for reducing the diameter of said bottomed cylindrical portion of the small diameter, while the bottom corner portion of said bottomed cylindrical portion of the small diameter formed by the drawing treatment being unwrinkled, thereby to shape said bottomed cylindrical portion of the small diameter into a diametrical small cylindrical portion of substantially the same diameter as that of said neck portion; and in that after this, one or two or more tapered faces formed between said small diametrical cylindrical portion and said curved shoulder face are extended and re-shaped into a smooth sloped face leading from said curved shoulder face by a pair of re-shaping tools having a surface shape of a straight longitudinal section approximating a tangential line drawn to a virtual curved face extending from said curved shoulder face, to form the shoulder portion shape into a smooth curved face of a straight longitudinal section leading from the curved shoulder face.

10. A manufacturing method for a bottle-shaped can as set forth in claim 7, characterized:

in that said neck portion shaping step is to curl the leading end portion of said small diametrical cylindrical portion opened, to form a curled portion and to thread the cylindrical portion below said leading end portion directly to form a thread.

11. A manufacturing method for a bottle-shaped can as set forth in claim 7, characterized:

in that said neck portion shaping step is to fit a cylindrical member of a resin threaded in advance, on said small diametrical cylindrical portion and to bend the leading end portion of said small diametrical cylindrical portion opened, outward to bring the same into engagement with said cylindrical member of the resin.

12. A manufacturing method for a bottle-shaped can as set forth in claim 1, characterized:

in that at said small diametrical cylindrical portion shaping step, said bottomed cylindrical can is preliminary molded at its bottom corner portion into a curved shoulder face of an arcuate longitudinal section and is then drawn at its bottom portion into a bottomed cylindrical portion of a smaller diameter than that of the body portion while the curved shoulder face of said bottom corner portion being unwrinkled by a pair of unwrinkling pusher and drawing dies having curved faces to contact with said curved shoulder face;

in that after this, an unwrinkling pusher, which is provided at its leading end portion with a tapered face having a generally straight longitudinal section approximating a tangential line drawn to an arcuate longitudinal section of a virtual curved face leading from a preformed curved shoulder face, a redrawing dies, which is positioned at a portion to confront at least said unwrinkling pusher and which is provided at its leading end portion with a tapered face having a generally straight longitudinal section approximating a tangential line drawn to an arcuate longitudinal section of a preformed curved shoulder face, and a redrawing punch are used to perform one or more redrawing treatments for reducing the diameter of said bottomed cylindrical portion of the small diameter diametrically, while the bottom corner portion of said bottomed cylindrical portion of the small diameter formed by the drawing treatment being unwrinkled, thereby to shape said bottomed cylindrical portion of the small diameter into a radially small cylindrical portion of substantially the same diameter as that of said neck portion; and in that after this, one or two or more continuing tapered faces formed between said small diametrical cylindrical portion and said curved shoulder face are extended and reshaped into a smooth curved face leading from said curved shoulder face by a pair of reshaping tools having a surface shape of a virtual curved face extending from said curved shoulder face, to form the shoulder portion shape into a curved face of a domed longitudinal section.

13. A manufacturing method for a bottle-shaped can as set forth in claim 12, characterized:

in that said neck portion shaping step is to curl the leading end portion of said small diametrical cylindrical portion opened, to form a curled portion and to thread the cylindrical portion below said leading end portion directly to form a thread.

14. A manufacturing method for a bottle-shaped can as set forth in claim 12, characterized:

in that said neck portion shaping step is to fit a cylindrical member of a resin threaded in advance, on said small diametrical cylindrical portion and to bend the leading end portion of said small diametrical cylindrical portion opened, outward to bring the same into engagement with said cylindrical member of the resin.

15. A manufacturing method for a bottle-shaped can as set forth in claim 1, characterized:

in that at said small diametrical cylindrical portion shaping step, said bottomed cylindrical can is preliminary molded at its bottom corner portion into a curved shoulder face of an arcuate longitudinal section and is then drawn at its bottom portion into a bottomed cylindrical portion of a smaller diameter than that of the body portion while the curved shoulder face of said bottom corner portion being unwrinkled by a pair of unwrinkling pusher and drawing dies having curved faces to contact with said curved shoulder face;

in that after this, an unwrinkling pusher, which is provided at its leading end portion with a sloped face having a generally straight longitudinal section approximating a tangential line drawn to an arcuate longitudinal section of a virtual curved face leading from a preformed curved shoulder face, a redrawing dies, which is positioned at a portion to confront at least said pusher, which is provided at its leading end portion with a sloped face having a generally straight longitudinal section approximating a tangential line drawn to an arcuate longitudinal section of a virtual curved face extending from the curved shoulder face which is provided at its portion on the leading end side from said sloped face with a bulging face having an arcuate longitudinal section, and a redrawing punch are used to perform one or more redrawing treatments for reducing the diameter of said bottomed cylindrical portion of the small diameter, while the bottom corner portion of said bottomed cylindrical portion of the small diameter formed by the drawing treatment being unwrinkled, thereby to shape said bottomed cylindrical portion of the small diameter into a diametrical small cylindrical portion of substantially the same diameter as that of said neck portion; and in that after this, one or two or more tapered faces formed between said small diametrical cylindrical portion and said curved shoulder face are extended and re-shaped into a smooth sloped face leading from said curved shoulder face by a pair of re-shaping tools having a surface shape of a straight longitudinal section approximating a tangential line drawn to a virtual curved face extending from said curved shoulder face, to form the shoulder portion shape into a smooth curved face of a straight longitudinal section leading from the curved shoulder face.

16. A manufacturing method for a bottle-shaped can as set forth in claim 15, characterized:

in that said neck portion shaping step is to curl the leading end portion of said small diametrical cylindrical portion opened, to form a curled portion and to thread the cylindrical portion below said leading end portion directly to form a thread.

17. A manufacturing method for a bottle-shaped can as set forth in claim 15, characterized:

in that said neck portion shaping step is to fit a cylindrical member of a resin threaded in advance, on said small diametrical cylindrical portion and to bend the leading end portion of said small diametrical cylindrical portion opened, outward to bring the same into engagement with said cylindrical member of the resin.

18. A manufacturing method for a bottle-shaped can as set forth in claim 1, characterized:

in that said neck portion shaping step is to curl the leading end portion of said small diametrical cylindrical portion opened, to form a curled portion and to thread the cylindrical portion below said leading end portion directly to form a thread.

19. A manufacturing method for a bottle-shaped can as set forth in claim 1, characterized:

in that said neck portion shaping step is to fit a cylindrical member of a resin threaded in advance, on said small diametrical cylindrical portion and to bend the leading end portion of said small diametrical cylindrical portion opened, outward to bring the same into engagement with said cylindrical member of the resin.

* * * * *

UNITED STATES PATENT AND TRADEMARK OFFICE

CERTIFICATE OF CORRECTION

PATENT NO. : 6,463,776 B1
DATED : October 15, 2002
INVENTOR(S) : Yasushi Enoki et al.

It is certified that error appears in the above-identified patent and that said Letters Patent is hereby corrected as shown below:

Column 6,
Line 37, change “G1mechanism” to -- mechanism --.

Signed and Sealed this

Twenty-fifth Day of March, 2003

JAMES E. ROGAN
*Director of the United States Patent and Trademark Office*